US010639560B2

(12) United States Patent
Mowbray

(10) Patent No.: US 10,639,560 B2
(45) Date of Patent: May 5, 2020

(54) GAS INFLATABLE BALLOONS

(71) Applicant: Creative Impact Inc., Road Town, Tortola (VG)

(72) Inventor: Mathew Peter Mowbray, Tortola (NZ)

(73) Assignee: CREATIVE IMPACT INC., Tortola (VG)

( * ) Notice: Subject to any disclaimer, the term of this patent is extended or adjusted under 35 U.S.C. 154(b) by 0 days.

(21) Appl. No.: 16/179,680

(22) Filed: Nov. 2, 2018

(65) Prior Publication Data

US 2019/0134521 A1 May 9, 2019

Related U.S. Application Data

(63) Continuation-in-part of application No. 15/953,912, filed on Apr. 16, 2018, and a continuation-in-part of application No. 15/478,567, filed on Apr. 4, 2017, now Pat. No. 9,962,619.

(30) Foreign Application Priority Data

| | | |
|---|---|---|
| Apr. 4, 2016 | (NZ) | 718690 |
| Dec. 23, 2016 | (NZ) | 727945 |
| Aug. 24, 2018 | (AU) | 2018220158 |

(51) Int. Cl.
*A63H 27/10* (2006.01)

(52) U.S. Cl.
CPC ..... *A63H 27/10* (2013.01); *A63H 2027/1033* (2013.01); *A63H 2027/1041* (2013.01); *A63H 2027/1075* (2013.01)

(58) Field of Classification Search
CPC .. A63H 27/10; A63H 2027/1041; A63H 3/06; A63H 2027/1033; A63H 23/10; A63H 2027/1083; A63H 27/04; A63H 2225/62
USPC ..... 446/181, 202, 220–330
See application file for complete search history.

(56) References Cited

U.S. PATENT DOCUMENTS

| | | | | |
|---|---|---|---|---|
| 262,517 A | | 8/1882 | Unz et al. | |
| 1,702,974 A | * | 2/1929 | MacDonald | F16K 15/202 116/DIG. 9 |
| 4,560,360 A | * | 12/1985 | Isaacs | A63H 27/10 446/222 |
| 4,708,167 A | * | 11/1987 | Koyanagi | F16K 15/147 137/512.15 |
| 4,721,491 A | | 1/1988 | Buchanan | |
| 4,911,674 A | | 3/1990 | Cole | |
| 4,917,646 A | * | 4/1990 | Kieves | A63H 27/10 137/846 |
| 5,029,851 A | | 7/1991 | Hagen | |
| 5,049,106 A | | 9/1991 | Kim et al. | |

(Continued)

OTHER PUBLICATIONS

Written Opinion, dated May 30, 2017, for International Application No. PCT/IB2017/051900, 6 pages.

*Primary Examiner* — Nini F Legesse
(74) *Attorney, Agent, or Firm* — Dentons US LLP

(57) ABSTRACT

A system and method for simultaneously inflating a plurality of balloons with pressurized gas issuing from a pressurized gas supply, each balloon being releasably or permanently attached to an inflation conduit which serves to duct gas from the gas supply to its respective balloon, and each balloon having an associated valve to control the release of gas from inside the balloon when connected and/or disconnected from its associated balloon.

19 Claims, 21 Drawing Sheets

(56) References Cited

U.S. PATENT DOCUMENTS

| | | | | | |
|---|---|---|---|---|---|
| 5,188,558 | A * | 2/1993 | Barton | A63H 27/10 | 446/220 |
| 5,234,726 | A | 8/1993 | Dahan | | |
| 5,245,991 | A | 9/1993 | Kawaguchi | | |
| 5,295,892 | A * | 3/1994 | Felton | A63H 27/10 | 446/220 |
| 5,306,194 | A | 4/1994 | Epstein | | |
| 5,482,492 | A * | 1/1996 | Becker | A63H 27/10 | 383/44 |
| 5,496,203 | A | 3/1996 | Murray | | |
| 5,860,441 | A * | 1/1999 | Garcia | A63H 27/10 | 137/15.18 |
| 6,176,758 | B1 * | 1/2001 | Wu | A63H 3/06 | 446/220 |
| 6,192,917 | B1 * | 2/2001 | Ramos Loza | A63H 27/10 | 137/223 |
| 6,478,651 | B1 | 11/2002 | Weir | | |
| 6,702,699 | B2 | 3/2004 | Touhey et al. | | |
| 7,708,616 | B2 * | 5/2010 | Phillips | A63H 27/10 | 446/220 |
| 8,789,565 | B1 | 7/2014 | Wicken | | |
| 9,315,282 | B2 | 4/2016 | Malone | | |
| 9,962,619 | B2 | 5/2018 | Mowbray | | |
| 10,252,174 | B2 * | 4/2019 | Morita | A63H 27/10 | |
| 2006/0291217 | A1 | 12/2006 | Vanderschuit | | |
| 2008/0265086 | A1 | 10/2008 | Lee | | |
| 2009/0047864 | A1 | 2/2009 | Burchett et al. | | |
| 2013/0118640 | A1 | 5/2013 | Saggio | | |
| 2013/0296140 | A1 | 11/2013 | Publicover et al. | | |
| 2014/0295728 | A1 | 10/2014 | Cayton | | |
| 2016/0039547 | A1 | 2/2016 | Malone | | |
| 2017/0282088 | A1 * | 10/2017 | Mowbray | A63H 27/10 | |

* cited by examiner

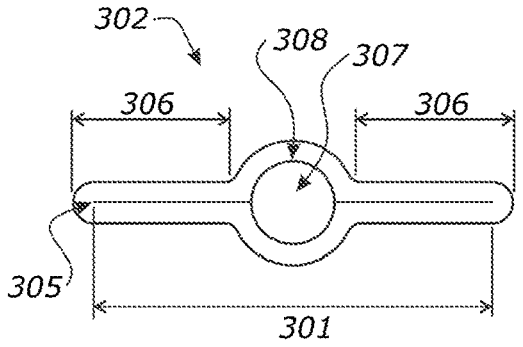
FIGURE 17E
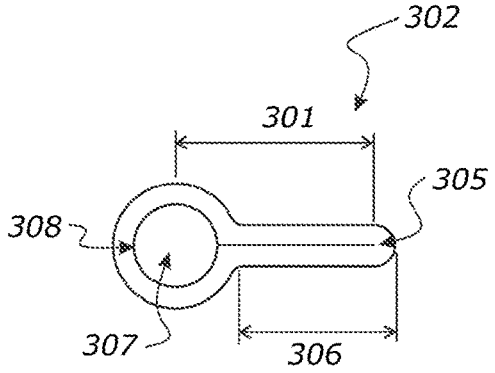
FIGURE 17F
FIGURE 17G
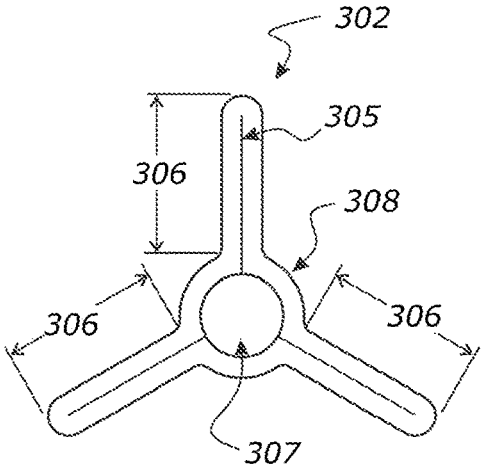
FIGURE 17H
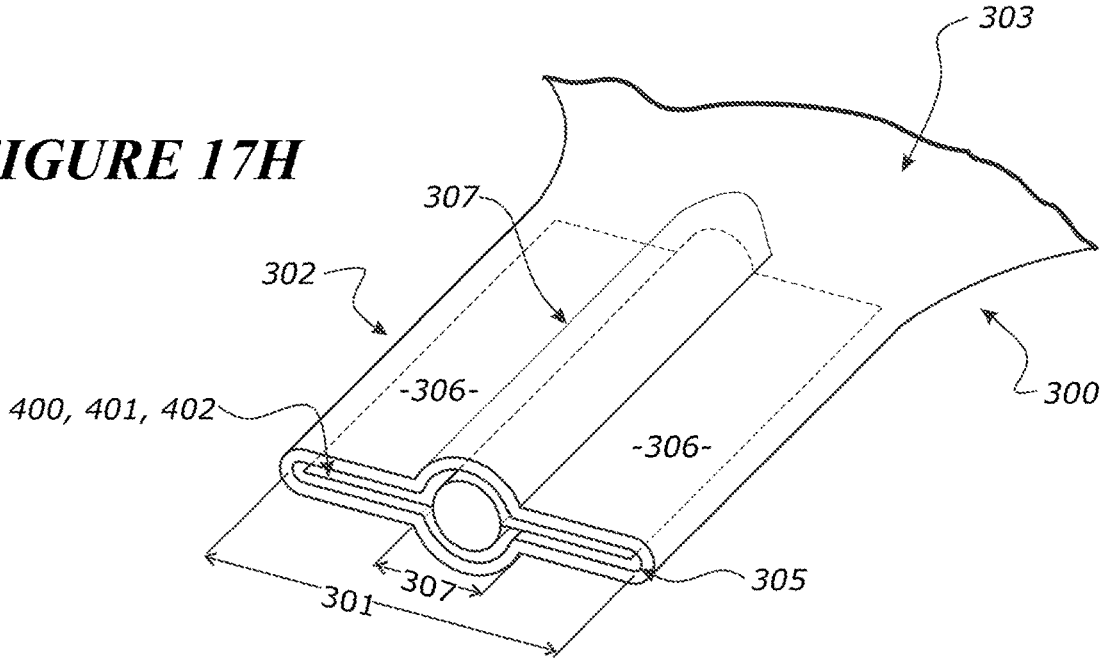

GAS INFLATABLE BALLOONS

BACKGROUND

Technical Field

The present disclosure relates to gas inflatable balloons.

Description of the Related Art

Inflating of balloons (such as party balloons) from a flaccid state with gas can be time consuming. Inflation is typically done by placing a person's mouth on the neck of a balloon and breathing air into the balloon. The neck of the inflated balloon is then sealed, normally by the person tying a knot in the neck. This can be difficult if the neck is very inelastic or short. Often party balloons are displayed by anchoring them to ceilings or walls of the like. Mostly they will hang from their anchor point unless filled with a gas lighter than air. The anchoring of a balloon usually requires the tying of a string to the neck of the balloon. The string is then tied or pinned at or near its free end to anchor the balloon in place. This adds further time to the process of displaying inflated balloons at a party or other function. For parties and other functions a large number of balloons often need to be inflated, sealed and anchored. The process of inflating, sealing and anchoring balloons can hence take a long time. It is accordingly an object of the present disclosure to provide gas inflatable balloons that are able to be inflated, sealed and anchored in a manner that at least overcomes some of the above mentioned disadvantages.

BRIEF SUMMARY

In one aspect the disclosure can be said to broadly consist in a system for simultaneously inflating a plurality of balloons with pressurized gas issuing from a pressurized gas supply, said system comprising:

a) a plurality of balloons, and b) a plurality of inflation conduits, each associated with a respective one of the balloons and configured to duct pressurized gas from the pressurized gas supply to said respective one of the balloons.

In some embodiments said system comprises a pressurized gas supply source from which the pressurized gas supply issues.

In another aspect the disclosure can be said to broadly consist in various components of a system for simultaneously inflating a plurality of balloons as herein described, alone or in combination with one or more of the other various components of said system.

In some embodiments one or more of said components may be provided in assembly with each other.

In some embodiments one or more of said components may be provided together in a disassembled kit of parts, suitable for assembly with each other.

In some embodiments said components may be provided together as a retail pack.

In another aspect the disclosure can be said to broadly consist in a plurality of balloons for use in a system for simultaneously inflating said plurality of balloons with pressurized gas issuing from a pressurized gas supply, wherein each one of said plurality of balloons is connected or connectable to an inflation conduit that is adapted to duct pressurized gas from the pressurized gas supply to said inflatable balloon.

In some embodiments said plurality of inflatable balloons may be provided as a retail pack.

In some embodiments said retail pack may further comprise a plurality of said inflation conduits.

In some embodiments said plurality of inflatable balloons may be supplied in the retail pack in connection with, or connectable to, a respective one of the plurality of inflation conduits.

In one aspect the disclosure can be said to broadly consist in a method of simultaneously inflating a plurality of balloons with pressurized gas issuing from a pressurized gas supply via a plurality of inflation conduits, each of said inflation conduits being configured to duct pressurized gas from the pressurized gas supply to a respective one of the balloons, wherein said method comprises the steps of:

a) providing a plurality of balloons, each in fluid communication with the pressurized gas supply via a respective one of the inflation conduits; and b) simultaneously inflating the balloons with pressurized gas.

In some embodiments the method further comprises the step of connecting the inflation conduits to be in fluid communication with the gas supply.

In some embodiments the method further comprises the step of releasing the inflation tubes from fluid communication with the gas supply.

In some embodiments the method further comprises the step of re-connecting one or more of the inflation conduits to be in fluid communication with the gas supply.

In some embodiments the method further comprises the step of connecting the balloons with the inflation conduits.

In some embodiments the method further comprises the step of disconnecting the balloons from the inflation conduits.

In some embodiments the method further comprises the step of re-connecting one or more of the balloons with respective ones of the inflation conduits.

In some embodiments the method further comprises the step of tethering or anchoring one of more of the balloons using one or more selected from:

a) a tether connected to the balloon;

b) an inflation conduit; and c) a connector of the balloon which is adapted to connect to both of the inflation conduit and an corresponding connector of a balloon support surface or frame.

In one aspect the disclosure can be said to broadly consist in a method of manufacturing a balloon for use in a system for simultaneously inflating a plurality of balloons with pressurized gas issuing from a pressurized gas supply, said system comprising:

a) a plurality of inflatable containers; and b) plurality of inflation conduits, each associated with a respective one of the balloons and configured to duct pressurized gas from the pressurized gas supply to said respective one of the balloons.

In some embodiments said balloon comprises an inflatable body with a neck region defining an opening of the inflatable body through which pressurized gas can pass to inflate the balloon, and wherein said balloon is connected or connectable to an inflation conduit that is adapted to duct pressurized gas from the pressurized gas supply to said inflatable body, and wherein said balloon carries a valve associated or associable with said inflation conduit and configurable between an open condition to permit the entry of gas to the inflatable body and a closed condition to restrict the egress of gas from said inflatable body, said valve being located inside the inflatable body, and wherein the method further comprises the step of sealing the opening of the inflatable body with a bond extending across the neck by pressing or pinching the neck closed with either one, or both, of the valve and the inflation conduit (if present) in situ.

The following options may apply to any one or more of the previously described aspects of the invention:

In some embodiments the system may permit the simultaneous delivery of gas to more than 5 balloons.

In some embodiments the system may permit the simultaneous delivery of gas to up to 10, 20, 30, 40 or 50 balloons.

In some embodiments the system may permit the simultaneous delivery of gas to more than 50 balloons.

In some embodiments said system comprises a pressurized gas supply source from which the pressurized gas supply issues.

In some embodiments said pressurized gas supply source is one or more selected from:

a) an electric pump;

b) a battery-operated pump;

c) a manually operated pump;

d) an air compressors;

e) a pressurized gas tank; and f) a pressurized gas canister.

In some embodiments the pressurized gas supply source is a helium gas tank operating at a pressure of approximately 1500 to 2000 kPa.

In some embodiments the pressurized gas supply source is an electric pump operating within the power range of 500 Watts-1000 Watts.

In some embodiments the system is configured to be able to simultaneously inflate a plurality of balloons within a time period of between 30 seconds and 3 minutes.

In some embodiments the pressurized gas contains one or more selected from:

a) air;

b) helium; and c) hydrogen.

In some embodiments the balloon may have an inflatable body and at least one opening into which pressurized gas can pass to inflate the balloon.

In some embodiments the inflatable body may be made of a flexible elastic material.

In some embodiments the inflatable body may be made of an inelastic material.

In some embodiments the inflatable body is made from one or more materials selected from:

a) rubber;

b) latex;

c) polychloroprene;

d) neoprene; and e) foil.

In some embodiments the inflatable body has a singular opening into which pressurized gas can pass to inflate the balloon.

In some embodiments the system is configured to permit reinflation of the balloon should gas from an inflated balloon leak out of the inflatable body.

In some embodiments each of the plurality of balloons is of a type of one or more selected from:

a) a party balloon;

b) a modelling balloon; and c) a foil balloon.

In some embodiments each of the plurality balloons are of the same type.

In some embodiments one or more of the balloons is of a different type to others of the plurality of balloons.

In some embodiments the plurality of balloons can together, and once inflated, define the shape or form of another object.

In some embodiments the second end of the inflation conduit is connected to or adapted for connection with the pressurized gas supply.

In some embodiments the first end of the inflation conduit may extend through the opening and into the interior of the inflatable body.

In some embodiments the first end of the inflation conduit may be received at the opening and connected thereto.

In some embodiments the inflation conduit may serve as one or more selected from a tether, an anchor, and a handle of the balloon.

In some embodiments the inflation conduit is flexible.

In some embodiments the inflation conduit is bendable between said first and second ends.

In some embodiments the inflation conduit is made from a material selected from one or more of:

a) polyethylene;

b) polyurethane; and c) PVC.

In some embodiments the inflation conduit is rigid.

In some embodiments the inflation conduit is made from an acrylic or polycarbonate material.

In some embodiments there are a plurality of inflation conduits which are all of an equal length.

In some embodiments there are a plurality of inflation conduits which are of a variety of different lengths.

In some embodiments the inflation conduit is not less than 50 mm in length.

In some embodiments the inflation conduit is between 300 mm and 1200 mm in length.

In some embodiments the inflation conduit is between 300 mm and 1000 mm in length.

In some embodiments the inflation conduit is between 500 mm and 1000 mm in length.

In some embodiments the inflation conduit has an internal diameter of 1-5 mm.

In some embodiments the inflation conduit has a wall thickness of 0.1-1.5 mm.

In some embodiments the inflation conduit has an external diameter which is less than 1% of the length of the inflation conduit.

In some embodiments there are a plurality of inflation conduits, wherein one or more of said plurality of inflation conduits are joined together along at least a part of their length.

In some embodiments one or more of said plurality of inflation conduits are joined together along substantially their entire length.

In some embodiments one or more of said plurality of inflation conduits are joined adjacent one another.

In some embodiments one or more of said plurality of inflation conduits are joined adjacent one another and co-extending parallel to each other.

In some embodiments said plurality of inflation conduits are joined adjacent one another in a ribbon formation.

In some embodiments the join between the plurality of inflation conduits is severable.

In some embodiments the plurality of inflation conduits includes at least 3, 4, 5, 6, 7, 8, 9 or 10 joined inflation conduits.

In some embodiments said plurality of inflation conduits are provided in a retail pack along with corresponding or greater number of balloons.

In some embodiments the retail pack includes a plurality of inflation conduits provided in a plurality of ribbon formations, said retail pack including between 2 and 10 ribbon formations.

In some embodiments the retail pack includes a plurality of inflation conduits provided in a plurality of ribbon formations, said retail pack including more than 10 ribbon formations.

In some embodiments the inflation conduit may be directly connected with the source of the pressurized gas supply.

In some embodiments the inflation conduit may be connected to the pressurized gas supply via an intermediate manifold.

In some embodiments the inflation conduit is connected to the pressurized gas supply at or near the second end of the inflation conduit.

In some embodiments the inflation conduit may be fixedly connected to the pressurized gas supply.

In some embodiments the inflation conduit may be releasably connected to the pressurized gas supply.

In some embodiments there are a plurality of inflation conduits, each releasably connected to the pressurized gas supply, wherein the system is configured to permit the release of an individual inflation conduit without compromising the supply of pressurized gas to the other inflation conduits.

In some embodiments the inflation conduit may be severable along its length.

In some embodiments the inflation conduit may be connected with the pressurized gas supply via an adapter configured accommodate to the simultaneous connection of a plurality of inflation conduits.

In some embodiments the adapter is configured to accommodate the simultaneous connection of 2, 3, 4, 8, 10, 20, 30, 40 or 50 inflation conduits.

In some embodiments the adapter is configured to accommodate the connection of a plurality of inflation conduits which are joined to one another.

In some embodiments the adapter is configured to accommodate the connection of a plurality of inflation conduits joined in a ribbon formation.

In some embodiments the adapter is configured to accommodate the connection of a plurality of ribbon formations.

In some embodiments there are a plurality of inflation conduits supplied in a retail pack along with a corresponding or greater number of balloons, where said retail pack further includes one or more adapters configured to accommodate the simultaneous connection of two or more of said plurality of inflation conduits to the pressurized gas supply.

In some embodiments the retail pack includes a selection of two or more adapters, each configured to simultaneously accommodate the connection of different numbers of inflation conduits.

In some embodiments the retail pack includes a selection of at least three adapters, a first adapter configured to accommodate a single ribbon formation, a second adapter configured to accommodate between two and four of said ribbon formations, and a third adapter configured to accommodate between three and six of said ribbon formations.

In some embodiments the adapter is has a selection of faces, each face configured to accommodate a different number of inflation conduits for simultaneous connection with the pressurized gas supply.

In some embodiments the adapter is a disc with at least two circumferentially spaced faces configured to accommodate different numbers of inflation tubes for simultaneous fluid connection with a pressurized gas outlet of a pump, wherein the disc is rotatably connected to a body of the pump and positioned to obstruct a port at the pressurized gas outlet, such that rotating the disc can selectively locate a respective one of said faces at the port in order to facilitate simultaneous fluid connection of inflation tubes with the pressurized gas supply.

In some embodiments pressurized gas is ducted to the balloon via an inflation conduit and enters the inflatable body through an opening.

In some embodiments the opening is at a neck of the balloon.

In some embodiments the system further comprises a valve configurable between an open condition which permits the flow of gas into the inflatable body, and closed condition which restricts the flow of gas egressing from the inflatable body.

In some embodiments the valve is located at or near the first end of the inflation conduit.

In some embodiments the valve is located at or near the second end of the inflation conduit.

In some embodiments the valve is located partway along the inflation conduit between the first and second ends.

In some embodiments the valve is located at the opening.

In some embodiments the valve is a crimp located on the inflation conduit, which in its closed condition crushes or pinches the inflation conduit to close off a flow of gas through the conduit, and which in its open condition is released to allow the re-opening of the inflation conduit so that the flow of gas can resume.

In some embodiments the valve is a one way valve.

In some embodiments the valve is one or more selected from:

a) a ball valve;

b) a swing disc; and c) a duckbill.

In some embodiments the valve is a duckbill valve.

In some embodiments the duckbill valve comprises two plies of material joined with one another in a manner to define a sealable passage therethrough.

In some embodiments the duckbill valve comprises two plies of material joined with one another in a manner to define a sealable passage therethrough, the first end of the inflation conduit being inserted into the passage with its exterior sealed against the plies or sheets to close off a first end of the passage, wherein the passage is able to collapse so as to seal the passage about the first end of the inflation conduit.

In some embodiments the plies are made of a thin flexible sheet material.

In some embodiments each of the plies are made of a flexible sheet material less than 1 mm in thickness.

In some embodiments the plies are made of thin flexible sheets of one or more selected from:

a) polyurethane;

b) polyester;

c) polypropylene; and d) PVC.

In some embodiments the plies are made from material, or materials, with a capacity to develop and hold an electrostatic charge.

In some embodiments each of the plies are of the same material.

In some embodiments each of the plies are of a different material.

In some embodiments each of the plies are of different materials, being materials which are separated from one another in the triboelectric series.

In some embodiments at least the inner surfaces of the plies which contact one another to seal the passage about the first open end of the tether have a roughened surface texture.

In some embodiments the duckbill valve is made from rubber or silicone.

In some embodiments the duckbill valve adopts a substantially flat profile in the closed condition.

In some embodiments the first end of the inflation conduit extends into an interior of the inflatable body inflatable through the opening, and the opening is sealed about the inflation conduit with a substantially gas tight seal.

In some embodiments the opening is sealed about the inflation conduit by clamping the inflatable body against the exterior of the inflation conduit.

In some embodiments the opening is of a lesser diameter than the inflation conduit and the opening is sealed about the inflation conduit by stretching the opening to allow the inflation conduit therethrough and then allowing the opening to contract around the exterior of the inflation conduit.

In some embodiments the opening is sealed about inflation conduit by bonding.

In some embodiments the bond is achieved by one or more selected from applying an adhesive, lamination, and heat welding.

In some embodiments the opening is at a neck of the inflatable container.

In some embodiments the first end of the inflation conduit extends into an interior of the inflatable body inflatable through the opening at the neck, and the neck is sealed about the inflation conduit with a substantially gas tight seal.

In some embodiments the neck is sealed about the inflation conduit by clamping the neck against the exterior of the inflation conduit.

In some embodiments the neck is of a lesser diameter than the inflation conduit and the neck is sealed about the inflation conduit by stretching the neck to allow the inflation conduit therethrough and then allowing the neck to contract around the exterior of the inflation conduit.

In some embodiments the neck is sealed about the inflation conduit by bonding.

In some embodiments the bond is achieved by one or more selected from applying an adhesive, lamination, and heat welding.

In some embodiments the neck is significantly larger that the external diameter of the inflation conduit.

In some embodiments the external diameter of the inflation conduit is less than ½ the diameter of the neck.

In some embodiments the external diameter of the inflation conduit is less than ¼ the diameter of the neck.

In some embodiments the first end of the inflation conduit is inserted into the inflatable body through the neck, and the neck is sealed about the inflation conduit by pressing or pinching the neck closed with the inflation conduit in situ.

In some embodiments the neck is sealed about the inflation conduit by pressing or pinching the neck closed with the inflation conduit in situ and applying an adhesive or heat weld at the pressed or pinched region of the neck.

In some embodiments the adhesive is applied in a flowable state to bead up across the opening.

In some embodiments the bond engages the inner surfaces of the neck such that it is not visible at the exterior of the balloon.

In some embodiments the valve is located at the opening of the inflatable body and incorporated into the bond between the inflation conduit and the inflatable body.

In some embodiments the valve is located at the neck of the inflatable body and incorporated into the bond between the inflation conduit and the neck.

In some embodiments the first end of the inflation conduit is inserted into the passageway of the valve and the valve is subsequently located inside of the neck, the neck is then sealed about the valve and inflation conduit by pressing or pinching the neck closed with the valve and inflation conduit in situ.

In some embodiments the neck is sealed about the valve and inflation conduit by pressing or pinching the neck closed with the valve and inflation conduit in situ and applying an adhesive or heat weld at the pressed or pinched region of the neck.

In some embodiments the balloon is releasably connected to the inflation conduit.

In some embodiments the valve includes a connector to releasably connect with the inflation conduit.

In some embodiments the connector is configured to releasably connect with the inflation conduit by receiving the first end of the inflation conduit in a sealed engagement.

In some embodiments the sealed engagement is achieved by way of a friction fit between the connector and the first end of the inflation conduit.

In some embodiments the connector is a tubular piece configured to releasably connect with the inflation conduit by engaging the first end of the inflation conduit in a friction fit.

In some embodiments the sealed engagement is achieved by way of a threaded engagement.

In some embodiments the valve is a duckbill valve comprising two plies of material joined with one another in a manner to define a sealable passage therethrough, and the connector is a tubular part adapted to engage with the first end of the inflation conduit in a releasable connection at an engagement region, and wherein the connector is located inside of the passage with the engagement region projecting out of a first end of said passage, and wherein the exterior of the connector is sealed against the plies to close off said first end of the passage.

In some embodiments the connector is a rigid part.

In some embodiments the opening of the inflatable body is sealed about the valve and its associated connector by bonding.

In some embodiments the opening is at a neck of the inflatable body.

In some embodiments the neck is sealed about the valve and its associated connector by bonding.

In some embodiments the bond is achieved by one or more selected from applying an adhesive, lamination, and heat welding.

In some embodiments the valve is located at the neck of the inflatable body and incorporated into the bonded region which seals the neck.

In some embodiments the valve and its associated connector are located at the opening of the inflatable body and incorporated into the bond sealing the opening of the inflatable body.

In some embodiments the valve and its associated connector are located at the neck of the inflatable body and incorporated into the bond sealing the neck.

In some embodiments the valve and its associated connector are located inside of the neck; the neck is then sealed about the valve and connector by pressing or pinching the neck closed with the valve and connector in situ.

In some embodiments the neck is sealed about the valve and connector by pressing or pinching the neck closed with the valve and connector in situ and applying an adhesive or heat weld at the pressed or pinched region of the neck.

In some embodiments the neck is significantly larger that the external diameter of the connector.

In some embodiments the external diameter of the connector is less than ½ the diameter of the neck.

In some embodiments the external diameter of the connector is less than ¼ the diameter of the neck.

In some embodiments the valve and its associated connector are inserted into the inflatable body through the neck, and the neck is sealed about the valve and connector by pressing or pinching the neck closed with the valve and connector in situ.

In some embodiments the neck is sealed about the valve and connector by pressing or pinching the neck closed with the valve and connector in situ and applying an adhesive or heat weld at the pressed or pinched region of the neck.

In some embodiments the adhesive is applied in a flowable state to bead up across the opening.

In some embodiments the bond engages the inner surfaces of the neck such that it is not visible at the exterior of the balloon.

In some embodiments the system may further comprise a deflation tube which can be inserted through the passageway of the valve to bring the interior of the inflatable body into fluid communication with the ambient atmosphere outside of the inflatable body.

In some embodiments the deflation tube is attached or attachable to the pressurized gas supply source.

In some embodiments the balloon has a tether.

In some embodiments the tether is permanently connected to the balloon.

In some embodiments the tether is between 200-1200 mm long.

In some embodiments the tether is between 500-1000 mm long.

In some embodiments the tether is between 700-900 mm long.

In some embodiments the tether may be a flexible cord.

In some embodiments the tether may be a flexible strip.

In some embodiments the tether has a coiled configuration.

In some embodiments the tether is incorporated into the connection between the balloon and the inflation conduit.

In some embodiments the tether is incorporated into the connection between the balloon and the valve.

In a further aspect the present disclosure may be said to be a balloon for use in a system for inflating balloons with pressurized gas issuing from a pressurized gas supply, said balloon comprising an inflatable body with a neck region defining an opening of the inflatable body through which pressurized gas can pass to inflate the balloon, and wherein said balloon is connected or connectable to an inflation conduit that is adapted to duct pressurized gas from the pressurized gas supply to said inflatable body, and wherein said balloon carries a valve associated or associable with said inflation conduit and configurable between an open condition to permit the entry of gas to the inflatable body and a closed condition to restrict the egress of gas from said inflatable body, said valve being located inside the inflatable body, and wherein at or adjacent the opening of the inflatable body the neck is bonded at a bonded region, said bonded region extending across the neck and having been formed by pressing or pinching the neck closed with either one, or both, of the valve and the inflation conduit (if present) in situ.

In some embodiments the bonded region is achieved by one or more selected from applying an adhesive, lamination, and heat welding.

In some embodiments the bonded region is achieved by applying an adhesive to engage interior surfaces of the neck such that the adhesive is not visible at the exterior of the balloon.

In some embodiments the bonded region is achieved by the application of adhesive in a flowable state, which adhesive forms a bead across the neck.

In some embodiments the valve is located at the opening of the inflatable body, inside of the neck, and incorporated into the bonded region.

In some embodiments the valve is a one-way valve.

In some embodiments the valve is a one-way valve that adopts a substantially flat profile in the closed condition.

In some embodiments the valve is duckbill valve comprising two plies of flexible sheet material joined with one another in a manner to define a sealable passage therethrough.

In some embodiments each of the plies are made of a flexible sheet material less than 1 mm in thickness.

In some embodiments the plies of the valve are made from one or more flexible sheet materials selected from polyurethane, polyester, polypropylene, and PVC.

In some embodiments the inflation conduit extends between a first end and a second end, and wherein said first end of said inflation conduit is inserted into the sealable passage of the valve with its exterior sealed against the plies to close off a first end of the passage, wherein the passage is able to collapse at a second end so as to seal the passage about the first end of the inflation conduit.

In some embodiments the diameter of the neck at the bonded region is significantly larger than the external diameter of the inflation conduit at the bonded region.

In some embodiments the external diameter of the inflation tube at the bonded region is less than ½ the diameter of the neck at the bonded region.

In some embodiments the external diameter of the inflation tube at the bonded region is less than ¼ the diameter of the neck at the bonded region.

In some embodiments the inflation conduit extends between a first end and a second end, and wherein the valve includes a connector to releasably engage with the first end of the inflation conduit.

In some embodiments the connector is a tubular piece configured to releasably connect with the inflation conduit by engaging the first end of the inflation conduit in a friction fit.

In some embodiments the connector is a tubular part adapted to releasably engage with the first end of the inflation conduit at an engagement region, and wherein the connector is located partially inside the sealable passage of the valve with the engagement region projecting out of a first end of said passage, and wherein the exterior of the connector is sealed against the plies to close off said first end of the passage, while the passage is able to collapse at a second end so as to seal the passage about an end of the connector opposing the engagement region.

In some embodiments the diameter of the neck at the bonded region is significantly larger than the external diameter of the connector and the inflation conduit when engaged.

In some embodiments the external diameter of the engaged connector and inflation tube is less than ½ the diameter of the neck at the bonded region.

In some embodiments the external diameter of the engaged connector and inflation tube is less than ¼ the diameter of the neck at the bonded region.

In some embodiments the said balloon has a permanently attached flexible tether of elongate cord or strip form.

In some embodiments the tether is permanently attached by incorporation into the bonded region at the neck of the balloon.

In some embodiments the said tether is provided in a coiled configuration.

In some embodiments the said inflatable body is made of an elastically expandable material.

In some embodiments the elastically expandable material is rubber.

In some embodiments the elastically expandable material is latex.

In some embodiments the balloon is configured to permit a user to orally inflate the balloon by blowing air through the opening of the inflatable body directly and/or through the inflation conduit (if present) to cause elastic expansion of the inflatable body.

In a further aspect the present disclosure may be said to be a system for simultaneously inflating a plurality of balloons with pressurized gas issuing from a pressurized gas supply, said system comprising:

a) a plurality of balloons; and b) a plurality of inflation conduits, each associated with a respective one of the balloons and configured to duct pressurized gas from the pressurized gas supply to said respective one of the balloons.

In some embodiments the system further comprises a pressurized gas supply source from which the pressurized gas supply issues.

In some embodiments the pressurized gas supply source is one or more selected from an electric pump, a battery-operated pump, a manually operated pump, an air compressor, a pressurized gas tank, and a pressurized gas canister.

In some embodiments the system is configured to be able to simultaneously inflate a plurality of balloons within a time period of between 30 seconds and 3 minutes.

In some embodiments each of said plurality of balloons comprises an inflatable body with an opening of the inflatable body through which pressurized gas can pass to inflate the balloon.

In some embodiments the opening is defined at a neck of the inflatable body.

In some embodiments the inflatable body is made of an elastically expandable material.

In some embodiments the elastically expandable material is rubber.

In some embodiments the elastically expandable material is latex.

In some embodiments the inflatable body is made of an inelastic material.

In some embodiments each of the plurality of balloons is of a type selected from one or more of a party balloon, a modelling balloon, and a foil balloon.

In some embodiments each balloon of the plurality balloons is of the same type.

In some embodiments each of the plurality of inflation conduits may serve as one or more selected from a tether, an anchor, and a handle of a respective one of the plurality of balloons.

In some embodiments each of the plurality of inflation conduits are flexible.

In some embodiments each of the plurality of inflation conduits is bendable between said first and second ends.

In some embodiments each of the plurality of inflation conduits has an internal diameter of 1-5 mm.

In some embodiments each of the plurality of inflation conduits has an external diameter which is less than 1% of the length of the inflation conduit.

In some embodiments one or more of said plurality of inflation conduits are joined together along at least a part of their length.

In some embodiments the plurality of inflation conduits are joined adjacent one another in a ribbon formation.

In some embodiments the join between the adjacent inflation conduits is severable.

In some embodiments each inflation conduit of the plurality of inflation conduits extends between a first end and a second end, the second end of the inflation conduit being connected to or adapted for connection with the pressurized gas supply.

In some embodiments the second end of the inflation conduit is fixedly connected to the pressurized gas supply.

In some embodiments the second end of the inflation conduit is releasably connected to the pressurized gas supply.

In some embodiments each of said inflation conduits is releasably connected to the pressurized gas supply, wherein the system is configured to permit the release of an individual inflation conduit without compromising the supply of pressurized gas to the other inflation conduits.

In some embodiments each of the plurality of inflation conduits are severable along their length.

In some embodiments the second end of each inflation conduit is connected with the pressurized gas supply via an adapter configured accommodate to the simultaneous connection of a plurality of inflation conduits.

In some embodiments the adapter is configured to accommodate the connection of a plurality of inflation conduits joined in a ribbon formation.

In some embodiments the each of said plurality of balloons carries a valve associated or associable with said inflation conduit and configurable between an open condition to permit the entry of gas to the inflatable body and a closed condition to restrict the egress of gas from said inflatable body.

In some embodiments the valve is a one-way valve.

In some embodiments the valve is a one-way valve that adopts a substantially flat profile in the closed condition.

In some embodiments the valve is duckbill valve comprising two plies of flexible sheet material joined with one another in a manner to define a sealable passage therethrough.

In some embodiments each of the plies are made of a flexible sheet material less than 1 mm in thickness.

In some embodiments the plies of the valve are made from one or more flexible sheet materials selected from polyurethane, polyester, polypropylene, and PVC.

In some embodiments the valve is located inside of the balloon.

In some embodiments at or adjacent the opening of the inflatable body the neck is bonded at a bonded region extending across the neck, said bonded region having been formed by pressing or pinching the neck closed with the valve and/or inflation conduit in situ.

In some embodiments the bonded region is achieved by one or more selected from applying an adhesive, lamination, and heat welding.

In some embodiments the bonded region is achieved by applying an adhesive to engage interior surfaces of the neck such that the adhesive is not visible at the exterior of the balloon.

In some embodiments the said bonded region is achieved by the application of adhesive in a flowable state, which adhesive forms a bead across the neck.

In some embodiments either one, or both, of the valve and the inflation conduit are incorporated into the bonded region which seals the neck.

In some embodiments the valve is located at or adjacent the opening of the inflatable body, inside of the neck, and incorporated into the bonded region.

In some embodiments the each of the inflation tubes extend between a first end and a second end, there being a respective one of the plurality of balloons being fixedly connected at or near the first end of the inflation tube.

In some embodiments the first end of the inflation conduit extends through the opening and into the interior of the inflatable body, the balloon being fixedly connected at or near the first end of the inflation tube by one or more selected from:

a) clamping the inflatable body to the exterior of the inflation conduit;

b) stretching the opening to allow the inflation conduit therethrough and then allowing the opening to contract around the exterior of the inflation conduit; or c) bonding the inflatable body to either, or both, of the valve and the exterior of the inflation conduit.

In some embodiments the conduit extends into the interior of the inflatable body, and wherein said valve is carried inside of the inflatable body and fixedly connected at the first end of the inflation conduit.

In some embodiments the valve is carried inside of the balloon at the opening of the inflatable body, and wherein the first end of the inflation conduit is received by and fixedly connected to the valve.

In some embodiments the inflation conduit extends between a first end and a second end, and wherein the valve is duckbill valve comprising two plies of flexible sheet material joined with one another in a manner to define a sealable passage therethrough, and wherein said first end of said inflation conduit is inserted into the sealable passage of the valve with its exterior sealed against the plies to close off a first end of the passage, wherein the passage is able to collapse at a second end so as to seal the passage about the first end of the inflation conduit.

In some embodiments the diameter of the neck at the bonded region is significantly larger than the external diameter of the inflation conduit.

In some embodiments the external diameter of the inflation tube at the bonded region is less than ½ the diameter of the neck at the bonded region.

In some embodiments the external diameter of the inflation tube at the bonded region is less than ¼ the diameter of the neck at the bonded region.

In some embodiments the inflation conduit extends between at first end and a second end, and wherein said balloon is releasably connected to said inflation conduit at or near the first end.

In some embodiments the valve is carried inside of the balloon at the opening of the inflatable body and releasably connected with the first end of the inflation conduit.

In some embodiments the valve includes a connector to releasably engage with the first end of the inflation conduit.

In some embodiments the connector is rigid.

In some embodiments the connector is a tubular piece configured to releasably connect with the inflation conduit by engaging the first end of the inflation conduit in a friction fit.

In some embodiments the connector is a tubular part adapted to releasably engage with the first end of the inflation conduit at an engagement region, and wherein the valve is a duckbill valve comprising two plies of flexible sheet material joined with one another in a manner to define a sealable passage therethrough, and wherein the connector is located partially inside the sealable passage of the valve with the engagement region projecting out of a first end of said passage, and wherein the exterior of the connector is sealed against the plies to close off said first end of the passage, while the passage is able to collapse at a second end so as to seal the passage about an end of the connector opposing the engagement region.

In some embodiments the diameter of the neck is significantly larger than the external diameter of the connector and the inflation conduit when engaged.

In some embodiments the external diameter of the engaged connector and inflation tube is less than ½ the diameter of the neck.

In some embodiments the external diameter of the engaged connector and inflation tube is less than ¼ the diameter of the neck.

In some embodiments the inflation conduit is made of a sheet material, for example a foil material.

In some embodiments the inflation conduit is formed from two coterminous pieces of sheet material sealed and/or bonded together save for a passage defined between the sheets.

In some embodiments the inflation conduit is formed from a single piece of sheet material folded upon itself and bonded to define a passage therethrough.

In some embodiments the inflation conduit can assume a substantially flat or near flat condition, except for when pressurized gas is introduced to the passage.

In some embodiments the inflation conduit is approximately the same width as the bonded region(s) extending across the neck of the balloons.

In some embodiments the inflation conduit is integrally formed with a duckbill valve at an end of the inflation conduit.

In some embodiments the inflation conduit is connected (for example by bonding and/or sealing) to the valve.

In some embodiments the balloon has a tether permanently connected to the balloon, said tether being distinct from the inflation conduit.

In some embodiments the tether is between 200-1200 mm long.

In some embodiments the tether is an elongate cord or strip.

In some embodiments the tether has a coiled configuration.

In some embodiments the tether is incorporated into the connection between the balloon and either, or both, of the inflation conduit and the valve.

In some embodiments each of said balloons is configured to permit a user to orally inflate the balloon by blowing air through the opening of the inflatable body directly or through the inflation conduit (if connected to the balloon) to cause elastic expansion of the inflatable body.

In yet a further aspect the present disclosure may be said to be a method of simultaneously inflating a plurality of balloons with pressurized gas issuing from a pressurized gas supply via a plurality of inflation conduits, each of said inflation conduits being configured to duct pressurized gas from the pressurized gas supply to a respective one of the balloons, and extending between a first end at which the balloon is or can be connected to the inflation conduit, and a second end which is adapted to connect to the gas supply, wherein said method comprises the steps of:

a) connecting said second ends of the plurality of inflation conduits to the gas supply; and b) simultaneously inflating the balloons with pressurized gas.

In some embodiments each of the plurality of balloons has a releasable connection with its associated inflation conduit, and is supplied disconnected from its associated inflation conduit, and wherein the method further comprises the step of connecting the first end of each of the inflation conduits with a respective one of the balloons prior to the step of simultaneously inflating the balloons.

In some embodiments each of the plurality of balloons has a releasable connection with its associated inflation conduit, and wherein the method further comprises the step of releasing each of the balloons from its associated inflation conduit after simultaneous inflation.

In some embodiments the method includes the step of removing the balloon from fluid communication with the gas supply after the step of simultaneously inflating the balloons.

In some embodiments the step of removing the balloon from fluid communication with the gas supply includes one or more selected from:

a) disconnecting the second end of the inflation tube from connection with the gas supply;

b) severing the inflation tube; and c) disconnecting the first end of the inflation tube from connection with the balloon.

In some embodiments the method utilizes a system for the simultaneous inflation of a plurality of balloons as herein described.

The term 'comprising' as used in this specification and claims means 'consisting at least in part of'. When interpreting statements in this specification and claims that include the term 'comprising', other features besides the features prefaced by this term in each statement can also be present. Related terms such as 'comprise' and 'comprised' are to be interpreted in a similar manner.

This disclosure may also be said broadly to consist in the parts, elements and features referred to or indicated in the specification of the application, individually or collectively, and any or all combinations of any two or more said parts, elements or features, and where specific integers are mentioned herein which have known equivalents in the art to which this disclosure relates, such known equivalents are deemed to be incorporated herein as if individually set forth.

As used herein the term 'and/or' means 'and' or 'or', or where the context allows both. The disclosure consists in the foregoing and also envisages constructions of which the following gives examples only.

Where steps of a method are set out it is not necessarily the case that the steps are performed in the listed order, or immediately preceding or proceeding one another. At least some of the method steps may be performed in alternative orders and/or with intervening steps and/or additional sub-steps.

BRIEF DESCRIPTION OF THE SEVERAL VIEWS OF THE DRAWINGS

Reference will now be made to the accompanying drawings in which:

FIG. 17E is a cross section of a neck of a balloon at its bonded region.

FIG. 17F is a cross section of a neck of a balloon at its bonded region showing an alternative arrangement to that of FIG. 17E.

FIG. 17G is a cross section of a neck of a balloon at its bonded region showing an alternative arrangement to that of FIGS. 17E and 17F.

FIG. 17H is a view of part of a balloon and neck wherein the bonded region is shown in a partially exploded view.

DETAILED DESCRIPTION

Figure 1:
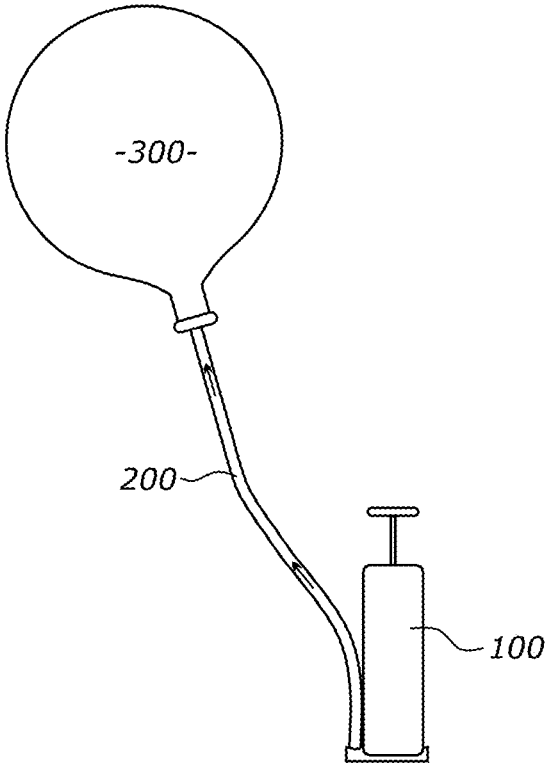
FIG. 1 shows an embodiment of a system for inflating a balloon comprising a balloon attached to a pressurized gas supply source via an inflation conduit.
Figure 2:
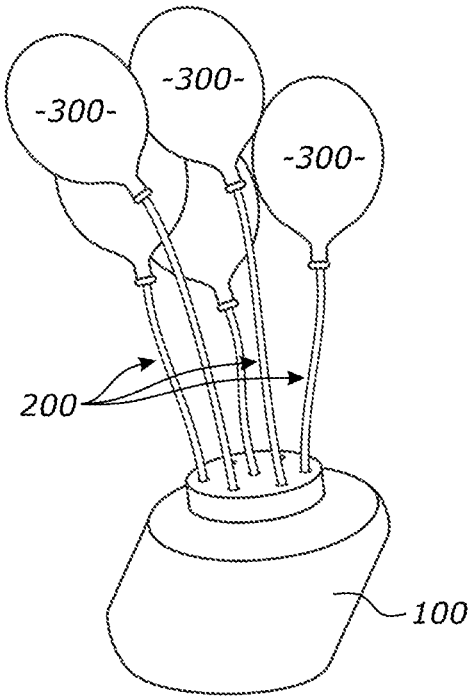
FIG. 2 shows an embodiment of a system for simultaneously inflating a plurality of balloons comprising a plurality of balloons attached to a pressurized gas supply source by a plurality of inflation conduits each connected to a respective one of the balloons.

In some embodiments the disclosure includes at least one inflatable balloon 300 which is able to be inflated by a pressurized gas issuing from a pressurized gas supply. The inflatable balloon 300 is or can be associated with an inflation conduit 200 that serves to duct gas from the gas supply into the inflatable balloon as shown in FIG. 1. In some embodiments there may be a plurality of inflatable balloons 300 arranged as part of a system to permit the simultaneous delivery of gas to more than one balloon at a time, for example as shown in FIG. 2. In some embodiments the system may permit the simultaneous delivery of gas to more than 5 balloons, or up to 10, 20, 30, 40 or 50 balloons at once. In some embodiments gas may be simultaneously delivered to even greater numbers of balloons.

In some aspects the disclosure involves the provision of one or more suitable balloons 300, a corresponding inflation conduit 200 and a pressurized gas supply source 100 together in an assembly, or as a disassembled kit, to be used for balloon inflation. In further aspects the disclosure involves provision as a retail pack of one or more suitable balloons 300, optionally accompanied by a respective inflation conduit 200, which can be connected to a suitable pressurized gas supply for used in a balloon 300 inflation system as herein described.

In further aspects the disclosure relates to a method of simultaneously inflating balloons 300, using inflation conduits 200 and a pressurized gas supply, for example as described.

There follows a discussion, with respect to the accompanying drawings, of various components which may be included in the balloon 300 inflation system.

Pressurized Gas Supply

Figure 11A:
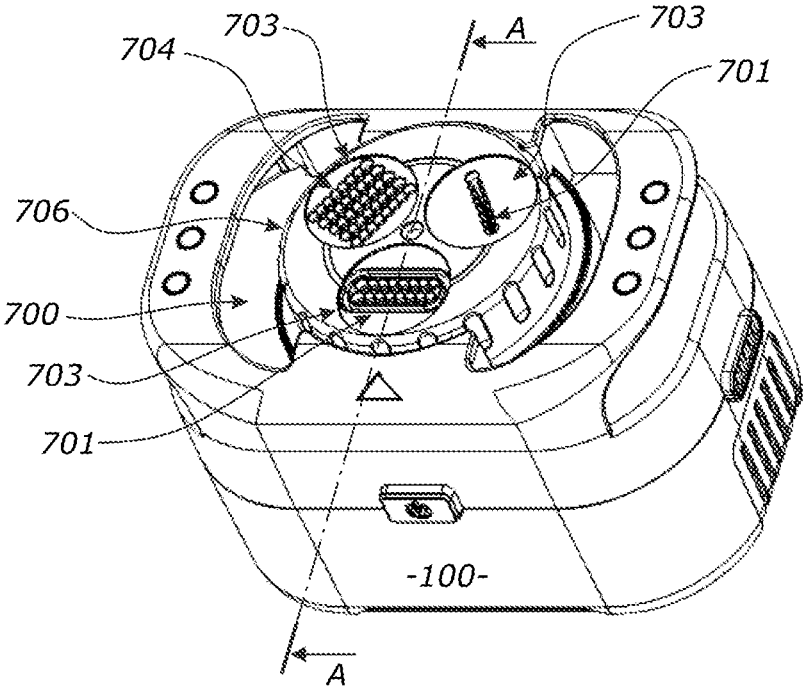
FIG. 11A shows an embodiment of a pump that may be used to supply pressurized gas to inflate a plurality of balloons, the pump carrying a disc shaped adapter with multiple faces, each face configured to accommodate a different number of ribbon formations, wherein the disc is rotatable to selectively align each of the faces with an outlet of the pump.

In some embodiments gas from a pressurized gas supply may be used to inflate the balloon(s) 300. The source 100 of the gas supply can be chosen depending on the number and type of balloons 300 to be inflated. For example, a latex party balloon 300 may be inflated with just 2 or 3 kPa gauge pressure, whereas some types of modelling balloons 300 may require more than 10 kPa gauge pressure to cause inflation. Examples of suitable sources for supplying pressurized gas include low-powered electric/battery-operated pumps, manually operated pumps, air compressors, and pressurized gas tanks such as helium gas tanks. As a further example, the pressurized gas source 100 could be a sealed canister of pressurized gas which can be punctured to release the gas into the inflation conduit(s) 200 and thus inflate the balloons 300. For particular examples of the variety of gas supply sources that may be used with, or included in, the system, see FIG. 1 showing a manual pump gas source, FIG. 2 showing an air compressor gas source, and FIG. 11A showing a battery operated pump gas source.

In some embodiments the pressure of the gas supply need not be particularly high, however it may be desirable for the system to be able to simultaneously inflate a plurality of balloons 300 (potentially to the point that at least one of the balloons 300 is destroyed) within a time period of between 30 seconds and 3 minutes and so the gas pressure and flow rate must be high enough to facilitate this. In one exemplary embodiment the source 100 of the gas supply may be a helium gas tank operating at a pressure of approximately 1500 to 2000 kPa, and the system may be configured to simultaneously deliver gas to approximately 30 latex party balloons 300 which can be inflated to become distended to a point just prior to bursting in approximately 40 seconds. The same 30 latex party balloons 300 may alternatively be inflated to the same point in around 60 seconds with air supplied by an approximately 600 Watt electric pump. An electric pump operating within the power range of 500 Watts-1000 Watts may also be sufficient.

A variety of pressurized gases could be used within the scope of the invention, with air and helium being examples of two suitable pressurized gases. Hydrogen is another gas which could be used in the system for filling balloons 300, as it is lighter than air and sometimes used in balloon 300 filling applications, but it is also highly flammable and may be less convenient for that reason.

Balloon(s)

The balloon 300 may have an inflatable body 303 to retain the gas delivered inside, and an opening 301 of the body into which pressurized gas can pass to inflate the balloon 300.

Figures 3A, 3B, 3C:
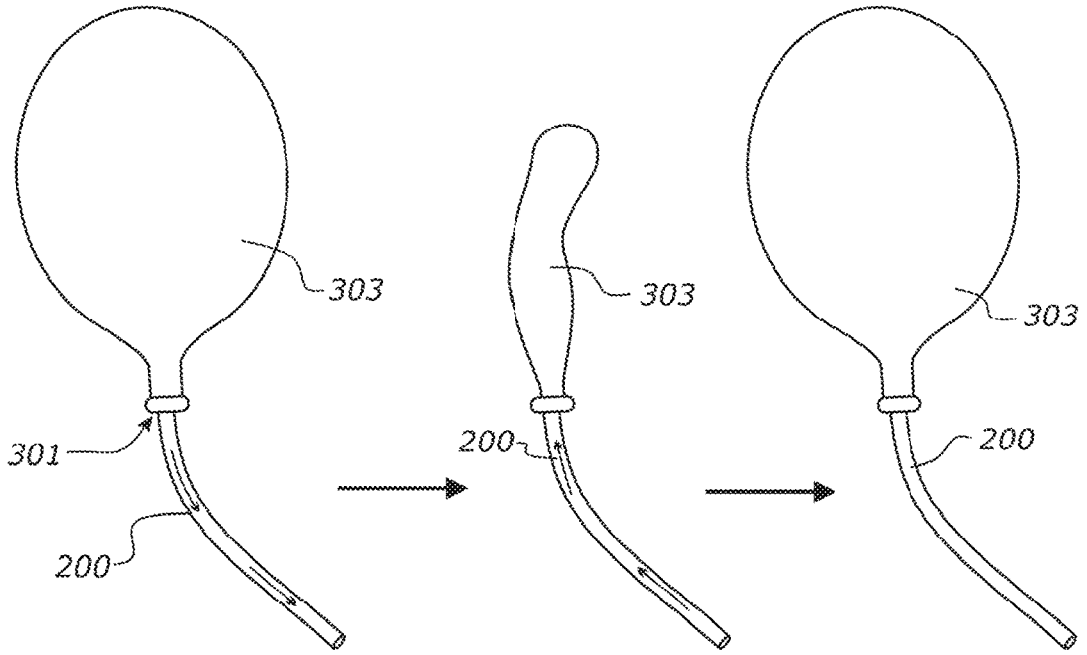
FIG. 3A shows an embodiment of an inflated balloon attached to an inflation conduit
FIG. 3B shows the balloon of FIG. 3A after having deflated to a flaccid condition
FIG. 3C shows the balloon of FIG. 3B after having been reinflated to an inflated condition.

On some occasions, the balloon 300 may be provided in a flaccid condition wherein the volume occupied by the inflatable body 303 is minimized and the pressure inside the inflatable body 303 is equal to ambient pressure. The inflatable body 303 can grow in volume, until it reaches a maximum volume and internal gauge pressure at which the inflatable body 303 ruptures. For example, the volume occupied by the inflatable body when flaccid may be less than 20% of its volume when fully inflated. The balloon could, for example, be inflatable to contain a volume of gas of at least 0.5 liters before rupture. In other embodiments that balloon may inflatable to hold a greater or lesser volume of gas, for example 2, 5 10 or 20 liters. FIG. 3 shows the inflatable body 303 contracting from an inflated condition to a flaccid condition, and then expanding to an inflated condition again.

However it is not always the case that inflation of the balloon 300 occurs from a flaccid state, and the disclosure may also serve to further inflate the inflatable body 303 of a balloon 300 which already contains a substantial volume of gas. For example, in some embodiments inflation of the balloon 300 may involve increasing the gas pressure inside the inflatable body 303 from a first pressure that is already above atmospheric pressure to an even higher pressure not exceeding the pressure of the inflatable body 303 at which the body will burst.

The inflatable body 303 may be made of a flexible elastically expandable material so that it can increase in volumetric displacement and increase in internal gas pressure when being inflated. Examples of suitable flexible elastic materials include materials like latex, rubber and neoprene. Alternatively the inflatable body 303 may be made of a flexible material which is inelastic (or at least has significantly less elasticity than rubber), which may still be increased in volumetric displacement as it is inflated by gas. An example of such an inelastic material is a foil made from, for example, a metallic coated nylon.

In some embodiments a singular opening 301 of the inflatable body 303 is the only way for gas to rapidly enter and/or leave the balloon 300. When the opening 301 is sealed, gas may leave the balloon 300 over a longer period of time by leaking through the wall of the balloon 300 due to the wall, in some constructions, being potentially very slightly permeable to the gas contained inside the body. But this is a slower process than if the gas were to leave via the opening 301/inflation conduit 200.

Figure 13A:
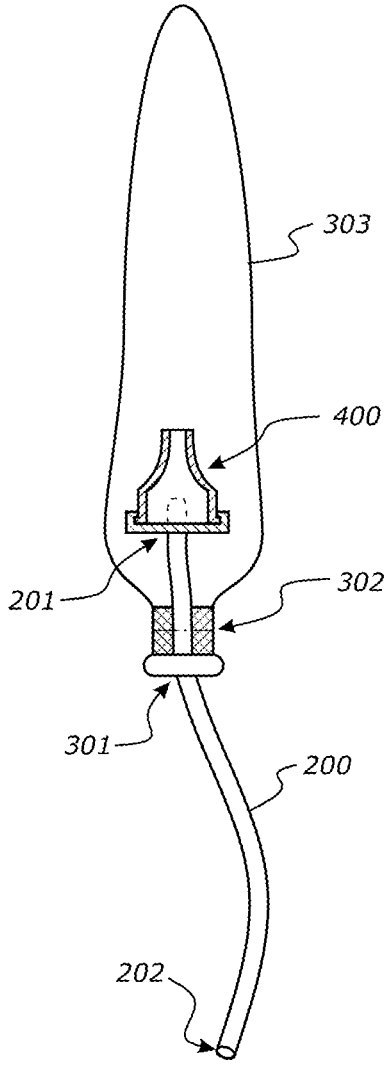
FIG. 13A shows an embodiment of a balloon connected to an inflation conduit, wherein the balloon has an inflatable body and carries a valve inside of the inflatable body, and wherein the inflatable body has deflated due to the leaking of gas.
Figure 13B:
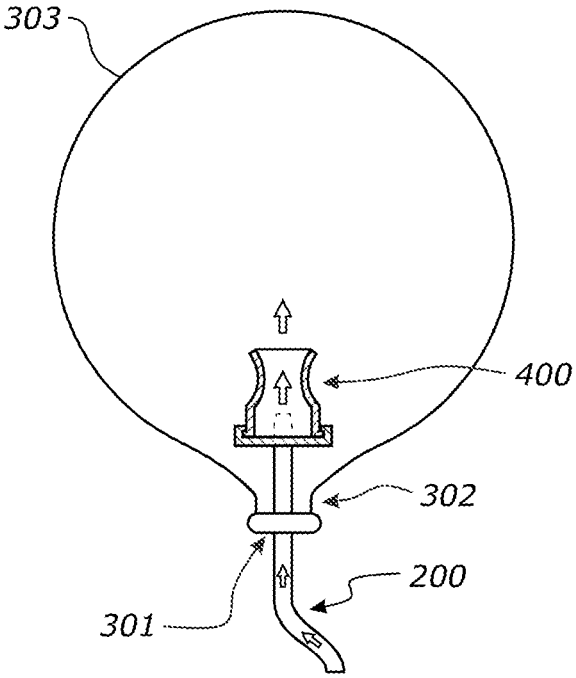
FIG. 13B shows the balloon of FIG. 13A being replenished by gas flowing into the inflatable body via the inflation conduit and valve.

In some embodiments there may be the ability for the balloon 300 to be re-inflated should gas from an inflated balloon 300 leak from the balloon 300. For example, a balloon may assume a deflated (or at least partially deflated) condition as shown in FIG. 13A due to the leaking of gas. Gas can again be delivered through the inflation conduit 200 to re-inflate the balloon 300, for example as seen in FIG. 13B. In some embodiments, it may be possible for a user to orally re-inflate the balloon 300 using lung pressure, either by blowing directly into the opening 301 of the inflatable body 303 or through the inflation conduit 200. In order for a user to blow directly into the opening 301 of the inflatable body 303, it would be necessary to firstly disconnect the balloon 300 from the inflation conduit 200, which capability is provided only in some embodiments of the invention.

In some embodiments the balloons 300 are party balloons 300, for examples those which inflate to a substantially ovoid form. Modelling balloons 300 which inflate to other shapes, for example that of an elongate sausage shape, could also be used. As a further example the body 303 of the balloons 300 may be made of foil, and the balloons may inflate to a range of shapes, such as those of three dimensional letters or animal forms. In embodiments involving a plurality of balloons 300, it need not be the case that all of the balloons 300 are of the same form or type. For example, in some embodiments it may be desirable to simultaneously inflate a plurality of balloons 300 of the same or different form, which together can define the shape or form of another object. An example is the simultaneous inflation of a plurality of balloons 300 which can together, in their inflated form, define the head, body and legs of an animal form.

Inflation Conduit(s)

In some embodiments the gas is delivered from the pressurized gas supply to the inflatable body 303 of the balloon 300 via the inflation conduit 200, the inflation conduit 200 typically extending between a first end 201 at which the balloon 300 is or can be attached, and a second end 202 which may be connected or connectable into fluid communication with the pressurized gas supply. Particular examples of suitable inflation conduits can be seen in FIGS. 1 through 6.

In some embodiments the first end 201 of the inflation conduit 200 may extend through the opening 301 and into the interior of the inflatable body 303, for example as shown in FIGS. 3, 4, 6 and 9. In other embodiments the first end 201 of the inflation conduit 200 may be received by the opening 301 and connected thereto, for example by being fixedly or releasably connected to the inflatable body 303 at its neck 302 region as shown in FIGS. 10, 13 and 15.

Figure 5:
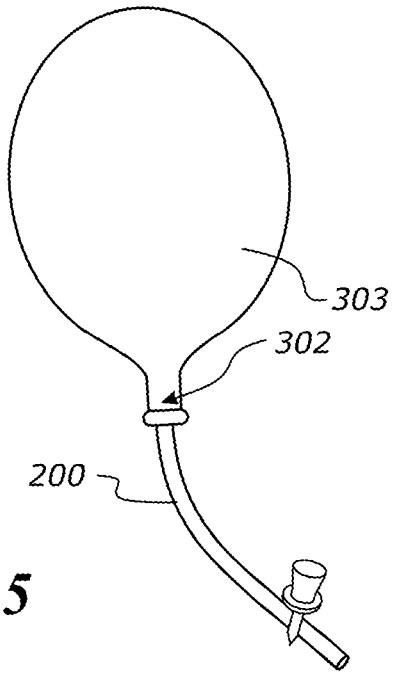
FIG. 5 shows an embodiment of a balloon connected to an inflation conduit, wherein the material of the inflation conduit is sufficiently soft to be manually punctured by a tack in order to permit the balloon to be anchored to a surface using the inflation conduit.
Figure 7:
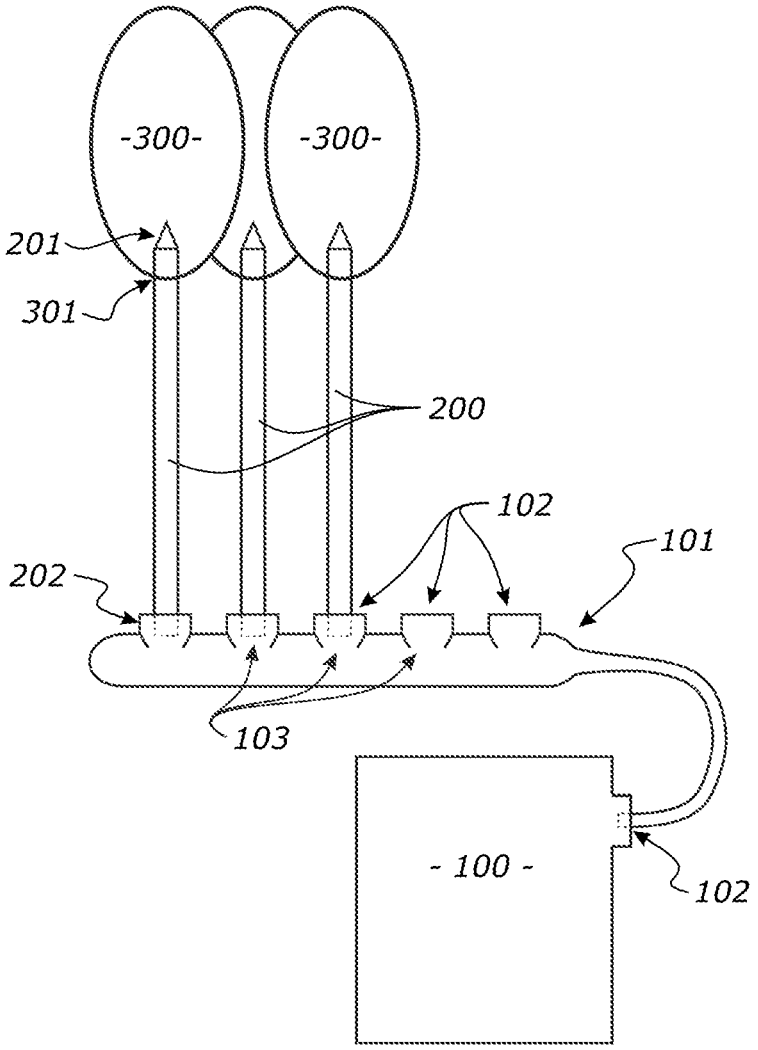
FIG. 7 shows an embodiment of a system for simultaneously inflating a plurality of balloons, comprising a plurality of balloons attached to a pressurized gas supply source by a plurality of inflation conduits each connected to a respective one of the balloons, wherein the inflation conduits are connected to the gas supply source via an intermediate manifold configured to permit the release of a single inflation conduit without compromising the gas supply to the remaining balloons.

In some embodiments the inflation conduit 200 may be flexible (for examples see FIGS. 5, 9, 10, 14 and 15), and in others the inflation conduit 200 may rigid (for examples see FIGS. 5 and 7). The inflation conduit 200 may be formed from a different material to that of the balloon 300.

Figure 6:
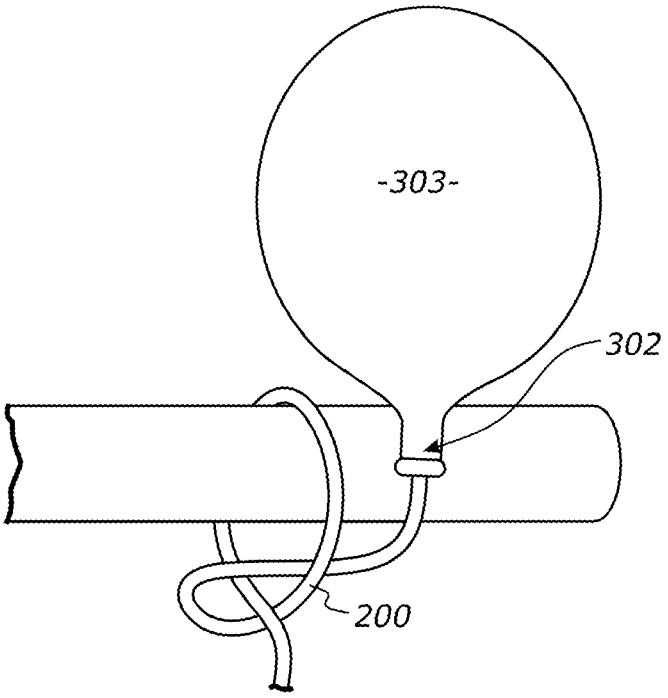
FIG. 6 shows an embodiment of a balloon connected to an elongate, flexible inflation conduit, wherein the inflation conduit has been used to tether the balloon to a pole.

In embodiments where the inflation conduit 200 is flexible it may be formed from a flexible material such as a bendable plastic like polyethylene, polyurethane or PVC. It may be bendable between its first and second ends so as to be able to assume a coiled configuration or to be tied in a knot without breaking. In such embodiments the inflation conduit 200 may be able to serve as an anchor or tether to attach the balloon 300 to a structure or surface. For example, the inflation conduit 200 may be of a sufficiently soft material to allow a thumb tack to be pushed through it by hand, in order to anchor the balloon 300 as shown in FIG. 5. As a further example, the inflation conduit 200 may be able to be wound or tied around a pole or frame to tether the balloon 300 as shown in FIG. 6.

Figure 4:
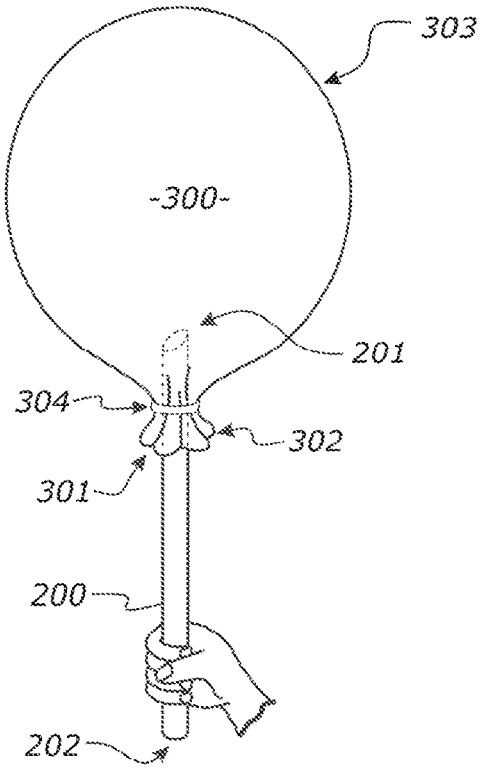
FIG. 4 shows an embodiment of a balloon comprising an inflatable body with a neck region projecting outwardly of the inflatable body, and an inflation conduit extending into the interior of the inflatable body through and opening at the neck of inflatable body, wherein the neck is clamped about the end of the inflation conduit in order to fixedly connect the inflation conduit with the balloon, and wherein the inflation conduit is rigid so as to be usable as a handle of the balloon.

In embodiments where the inflation conduit 200 is rigid it may be formed from a rigid material such as acrylic or polycarbonate. In such embodiments the inflation conduit 200 may be able to serve as a handle or support to hold the balloon 300 aloft as shown in FIG. 4.

Figure 8A:
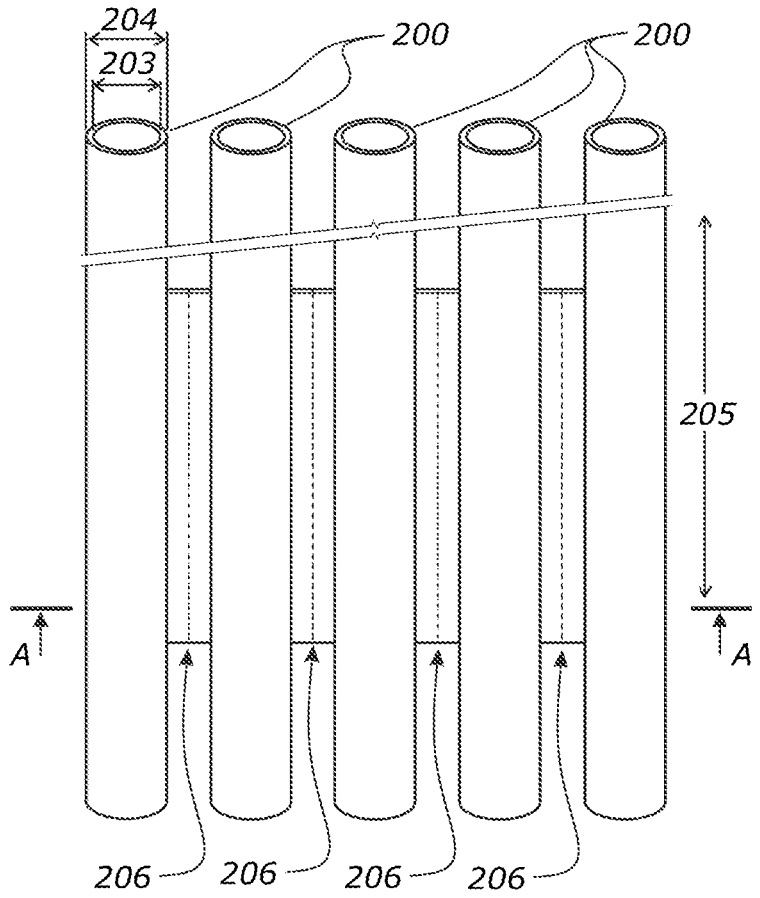
FIG. 8A shows an embodiment of a plurality of adjacent inflation conduits joined along at least part of their lengths by a frangible web.
Figure 8B:
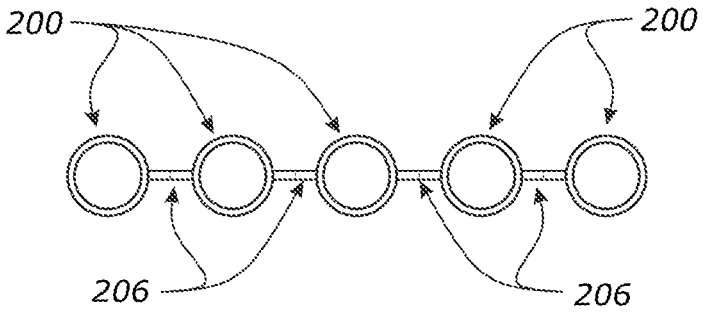
FIG. 8B shows a section view through plane A-A denoted on FIG. 8A.

In some embodiments the inflation conduit 200 is of tubular form, having an internal 203 and external diameter 204 as shown in FIGS. 8A, 8B. While the inflation conduit 200 may be of circular cross section, this need not be the case. The inflation conduit 200 may have a substantially constant cross section over its length 205, and preferably does not discernibly expand in cross section or length under the pressure of the inflation gas. In some embodiments there may be a plurality of inflation conduits 200 which are all of an equal length 205, and in others the inflation conduits 200 may not all be of the same length 205, and may also all be of different lengths 205.

In some embodiments the inflation conduit 200 is elongate, in that its external cross sectional diameter is significantly lesser than its length 205. If the inflation conduit 200 is too long it may become unwieldy in use by some users or in some applications. For example, in embodiments of the disclosure which involve a plurality of flexible inflation conduits 200, the inflation conduits 200 may tangle with one another if they are very long. However, if the inflation conduit 200 is too short it may not be long enough to be useable as an anchor, tether or handle of its associated balloon 300. A convenient length of the inflation conduit 200 may be not less than 50 mm, and somewhere between 300 mm and 1200 mm in length. In some embodiments the inflation conduit 200 may be between 300 mm and 1000 mm long, or more specifically between 500 mm and 1000 mm long.

The length 205 of the inflation conduit 200 and relative to the size of its diameter may also contribute to the performance and appearance of the inflation conduit 200. For example, if the internal diameter 203 of the inflation conduit 200 is very small, this may create resistance to the flow of the pressurized gas supply inside the conduit 200. Conversely if the external diameter 204 of inflation conduit 200 is too large, this may detract from the appearance of the balloon 300 and inflation conduit 200 in assembly where a thin and unobtrusive conduit 200 is more desirable. The dimensions of the inflation conduit 200 may be chosen accordingly. For example, a suitable internal diameter 203 of the inflation conduit 200 (given the convenient length dimensions listed in the preceding paragraph) could be between 1 mm and 5 mm, optionally with a conduit 200 wall thickness of 01. mm to 1 mm, or 0.1 mm to 1.5 mm. In some embodiments the external diameter 204 of the inflation conduit 200 may be less than 1% of the length of the inflation conduit 200.

Figure 9A:
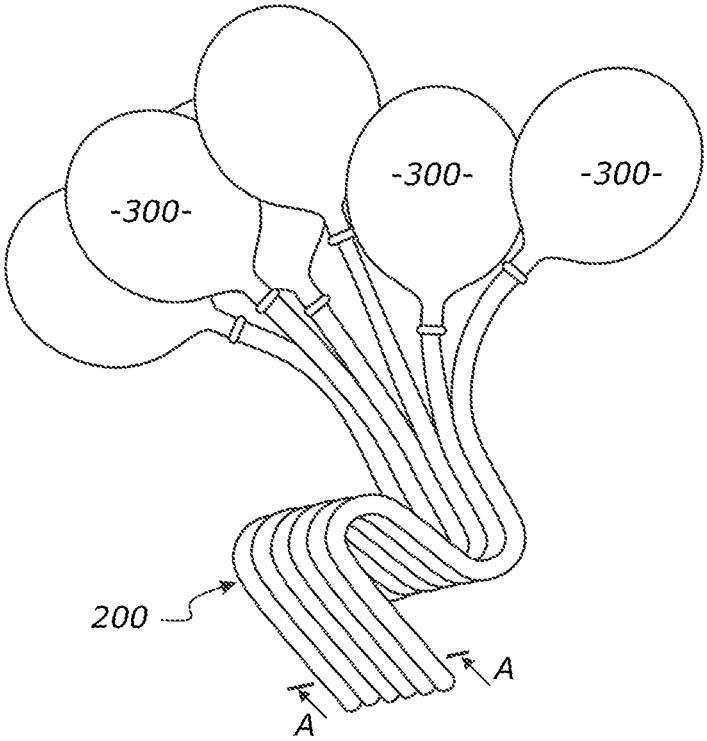
FIG. 9A shows an embodiment of a plurality of adjacent inflation conduits joined along their length in a ribbon formation.
Figure 9B:
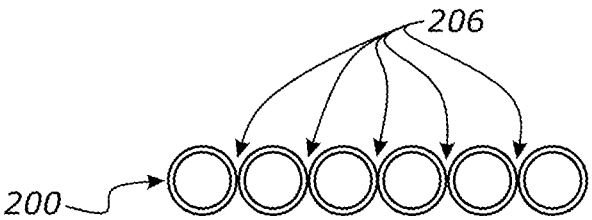
FIG. 9B shows a section view through plane A-A denoted on FIG. 9A.

In embodiments comprising a plurality of inflation conduits 200, one or more (and optionally all) of the inflation conduits 200 may be joined together along at least a part of their length 205. In some embodiments the inflation conduits 200 may be joined together along substantially all of their length. In some embodiments the inflation conduits 200 may be joined in an arrangement whereby they are adjacent one another, and preferably run parallel to each other, for example as shown in FIG. 8. In some embodiments the inflation conduits 200 are joined adjacent one another with their longitudinal axes aligned to adopt a ribbon formation as shown in FIG. 9. Such a joined configuration may assist in the convenience of handling the plurality of inflation conduits 200, and in particular in attaching a plurality of inflation conduits 200 at the pressurized gas source 100. Where multiple balloons 300 and inflation conduits 200 are sold together in a retail pack, it can be convenient to join the inflation conduits 200 for compact packaging and to help prevent them from tangling with one another.

In some embodiments the join 206 between inflation conduits 200 is severable so that one or more of the inflation conduits 200 may be separated off from the joined plurality as desired. For example, as shown in FIG. 9, the outer surfaces of adjacent inflation conduits 200 may be heat welded or glued together, with the welded or glued join being sufficiently weak that the inflation conduits 200 can be torn away from one another to separate them. As another example, shown in FIGS. 8A and 8B, adjacent inflation conduits 200 may be joined along their length 205 by a frangible web 206 extending between them.

Where such joined inflation conduits 200 are provided, along with suitable balloons 300, in a retail pack 800, it is preferable that the retail pack 800 includes at least 3 joined inflation conduits 200. In specific examples the retail pack may include 3 joined inflation conduits 200, 4 joined inflation conduits 200, 5 joined inflation conduits 200, 6 joined inflation conduits 200, 7 joined inflation conduits 200, 8 joined inflation conduits 200, 9 joined inflation conduits 200, or 10 joined inflation conduits 200, along with a corresponding or greater number of balloons 300. In some embodiments the joined inflation conduits 200 are provided in the previously described ribbon formation, and there may be included at least 2, and up to 10 or more of said ribbon formations inside the retail pack.

Connection Between Inflation Conduit(s) and Pressurized Gas Supply

In some embodiments the gas is delivered from the pressurized gas supply to the inflatable body 303 of the balloon 300 via the inflation conduit 200, the inflation conduit 200 typically extending between a first end 201 at which the balloon 300 is or can be attached, and a second end 202 which may be connected or connectable into fluid communication with the pressurized gas supply. In some embodiments the connection may be a direct connection with the source 100 of the pressurized gas supply, or alternatively the connection may be via an intermediate manifold 101, for example a manifold with multiple outlets 102 that can distribute gas from a single outlet 102 of the gas supply source 100 to a plurality of balloons 300 at the same time.

In some embodiments the connection between the second end 202 of the inflation conduit 200 and the pressurized gas supply can be releasable. In embodiments where a plurality of balloons 300 are to be simultaneously inflated, it may be desirable that the release of a single inflation conduit 200 can occur without compromising the gas supply to the other balloons 300 remaining in the system. An example of how this can be achieved is shown in FIG. 7, wherein a plurality of balloons 300 are connected to a gas supply 100 via an intermediate manifold 101, the intermediate manifold 101 having a plurality of outlet ports 102 each able to receive an inflation conduit 200 associated with a respective one of the balloons 300. Each outlet port 102 has a valve 103 that is caused to open when an inflation conduit 200 is connected to the port, but which is spring loaded to automatically close if the inflation conduit 200 is subsequently disconnected from the port.

In some embodiments the inflation conduit 200 may be severable along its length, for example by cutting, tearing or snapping. Severing the inflation conduit 200 may provide a way to remove a balloon 300 from being in fluid communication with the pressurized gas supply. Severing the inflation conduit 200 at a location remote from where it attaches to the balloon 300 may permit that the portion of the inflation conduit 200 which remains associated with the balloon 300 can subsequently be used as a tether, anchor or handle of the balloon 300.

Figure 10A:
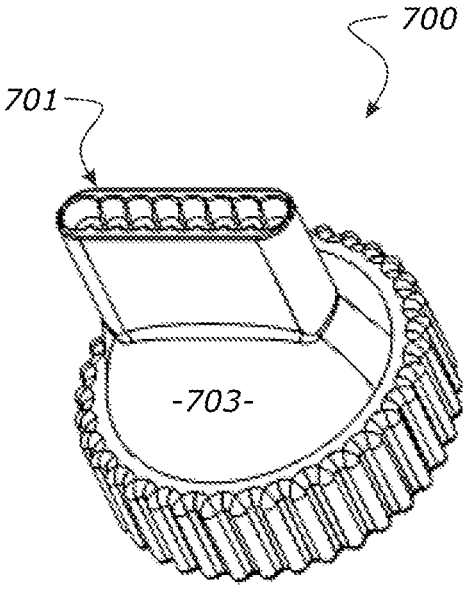
FIG. 10A shows an embodiment of an adapter for use in connecting a plurality of inflation conduits with a pressurized gas supply source, the adapter having an aperture to accommodate a plurality of inflation conduits joined adjacent one another in a ribbon formation.
Figure 10B:
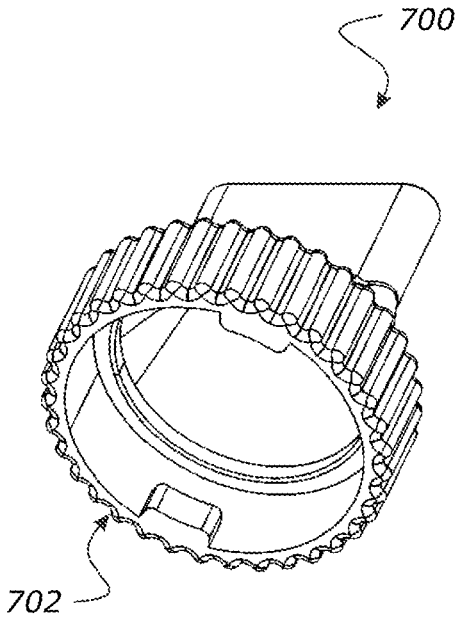
FIG. 10B shows a rear view of the adapter of FIG. 10A, wherein the adapter has a threaded connection for engaging with a correspondingly threaded outlet of a pressurized gas supply source.
Figure 10C:
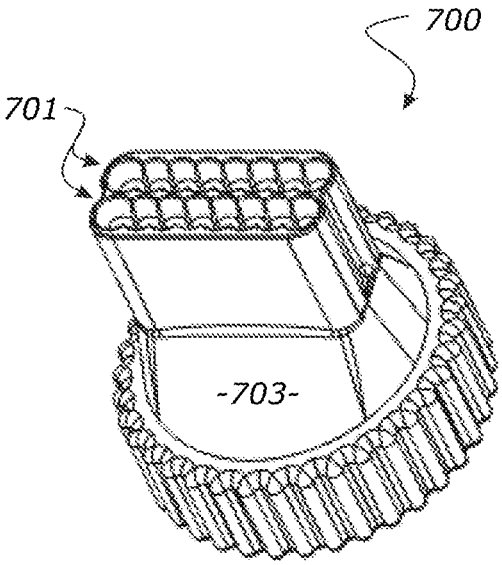
FIG. 10C shows a different embodiment of the adapter of FIGS. 10A and 11B which is configured to accommodate two ribbon formations.
Figure 10D:
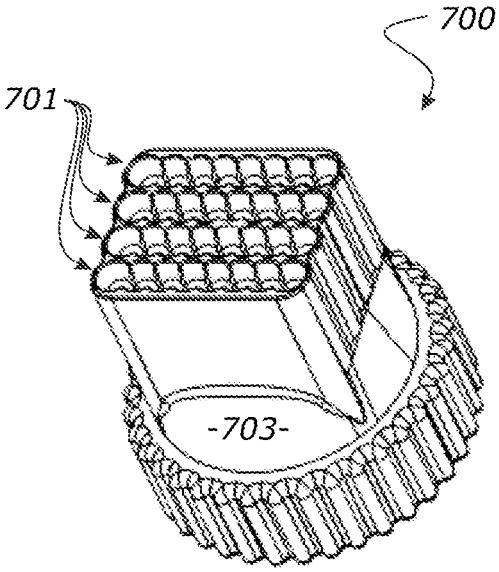
FIG. 10D shows a different embodiment of the adapter of FIGS. 10A and 11B which is configured to accommodate four ribbon formations.

In some embodiments there may be an adapter 700 which can connect to an outlet 102 of the pressurized gas supply source 100 to accommodate the simultaneous connection of a plurality of inflation conduits 200. For example, the adapter 700 may accommodate the connection of 2, 3, 4, 8, 10, 20, 30, 40 or 50 inflation conduits 200 simultaneously. In some embodiments the adapter 700 is configured to present the inflation conduits 200 for receiving gas issuing from the pressurized gas supply in parallel. In some embodiments the adapter 700 may accommodate the connection of a plurality of inflation conduits 200 which are joined adjacent one another. For example, FIGS. 10A, 10B show an adapter 700 with a threaded connection region 702 that can engage with a correspondingly threaded outlet port 102 on a standard pressurized helium supply tank, and which adapter 700 has a face 703 with an aperture 701 that can accommodate a plurality of inflation conduits 200 connected in the ribbon formation illustrated in FIG. 9A. FIG. 10C shows an embodiment of a similar adapter 700 with a face that has 2 apertures 701 to accommodate up to 3 of said ribbon formations. FIG. 10D shows an embodiment of a similar adapter 700 with a face that has 4 apertures 701 to accommodate up to 4 of said ribbon formations. Adapters which can accommodate any number of ribbon formations, for example 1, 2, 3, 4, 5 or 6 ribbon formations, could be used to facilitate connection with the pressurized gas supply.

Figure 11B:
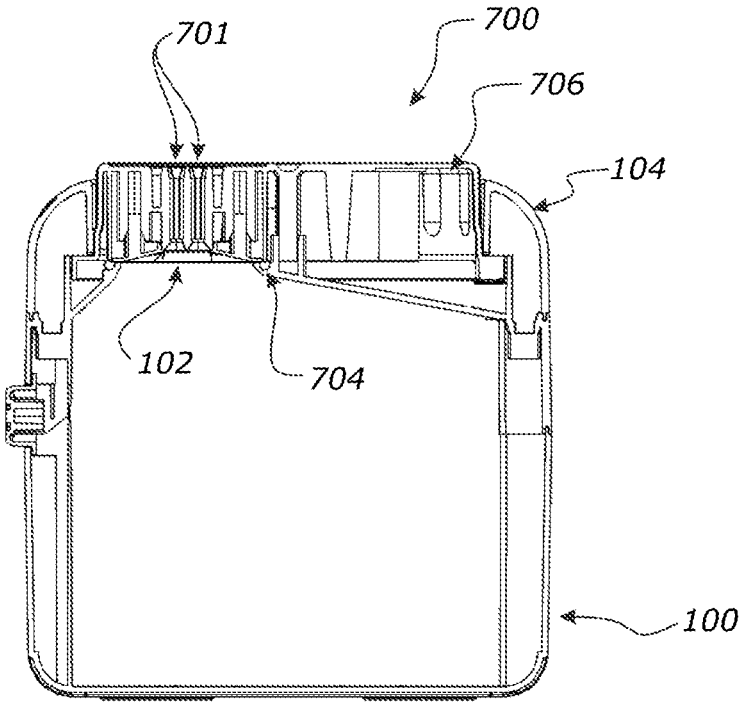
FIG. 11B shows a section view through plane A-A denoted on FIG. 11A.

In some embodiments, where various or all components of the system are supplied together in an assembly, in a kit and/or in a retail pack 800, there may be a selection of adapters 700 provided in or with the assembly, kit and/or retail pack to accommodate different numbers of inflation conduits 200 for simultaneous inflation. In other embodiments there may be a single adapter 700 supplied, said adapter 700 having a selection of faces, each face able to accommodate a different number of inflation conduits 200 for simultaneous inflation. In this embodiment it may be possible for a user to select between the different faces of the adapter 700 depending on the number of inflation conduits to be simultaneously connected. For example, FIGS. 11A and 11B show a pump 100 comprising a pump body, and a disc which is rotatably fixed to the pump body and positioned to obstruct an outlet port of the pump from which the pressurized gas supply issues. The disc bears three circumferentially spaced adapter 700 faces, each adapter 700 face providing apertures for receiving a different number of inflation conduits 200. The first adapter 700 face can accommodate 8 inflation conduits 200, the second 16 inflation conduits 200 and the third 24 inflation conduits 200. The disc can be rotated to selectively position a particular one of the adapter 700 faces over the outlet port, depending on the number of balloons 300 that a user desires to simultaneously inflate. There may be some kind of location feature (for example, such as in a bayonet fitting) to assist a user in aligning the desired adapter face 703 with the outlet port 102. There may also be a gasket surrounding the outlet port to effect a sealing of the outlet port against the disc and to reduce any loss in inflation pressure.

Valve, Connection Between Inflatable Container(s) and Inflation Conduit(s)

In some embodiments pressurized gas is ducted to the balloon 300 via an inflation conduit 200 and enters the inflatable body 303 through an opening 301, and in some embodiments the opening 301 may be at neck 302 region projecting outwardly of the inflatable body 303 as shown in FIG. 13A.

In some embodiments there may also be a valve 400 which is movable between an open condition that permits the flow of gas through the valve, and a closed condition that restricts the flow of gas through the valve. Closing the valve 400 can therefore serve to restrict the escape of gas from the inflatable body 303 once the balloon 300 is inflated. The valve 400 could be located at or near either of the first 201 and second 202 ends of the inflation conduit 200, or could alternatively be located at a point along the inflation conduit 200 between those first and second ends, where the valve 400 controls the passage of gas along the inflation conduit 200 to help prevent the escape of gas via the inflation conduit 200. Alternatively the valve 400 could be located at the opening 301 of the inflatable body 303 itself.

Figure 12A:
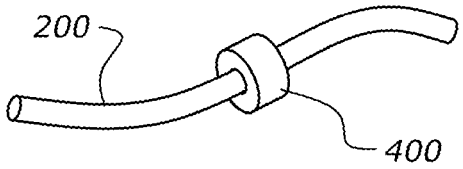
FIG. 12A shows an embodiment of a crimp applied to an exterior of the inflation conduit, the crimp being configured to an open conduit which permits the flow of gas through the inflation conduit.
Figure 12B:
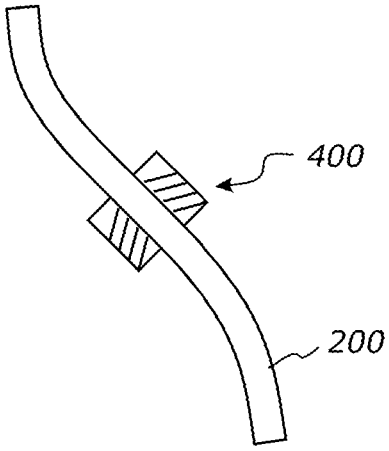
FIG. 12B shows a cut away view of the crimp of FIG. 12A.
Figure 12C:
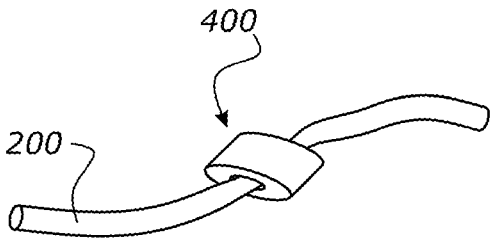
FIG. 12C shows the crimp of FIG. 12A configured to a closed condition which restricts the flow of gas through the inflation conduit.
Figure 12D:
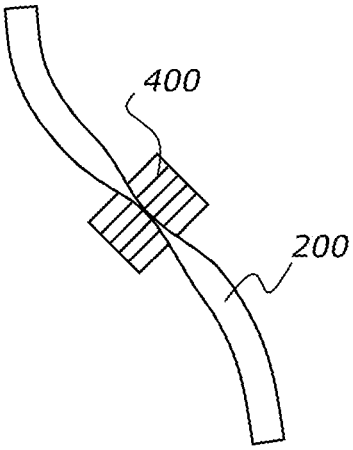
FIG. 12D shows a cut away view of the crimp of FIG. 12C.

For example, in some embodiments where the inflation conduit 200 is made of a flexible material, the valve 400 may be a manually applied crimp located along the inflation conduit 200 and externally of the balloon 300 as shown in FIGS. 12A through 12D. The crimp 400 can, in a closed condition, crush or pinch the inflation conduit 200 to close off the internal passageway and restrict the flow of gas to/from a connected balloon as shown in FIGS. 12C and 12D. The crimp 400 can then be released to an open condition, allowing the internal passageway of the inflation conduit 200 to re-open so that gas can pass, as shown in FIGS. 12A and 12B.

However in some embodiments the valve 400 is a one way valve, such as a ball valve, swing disc, or duckbill, which automatically configures between its open and closed conditions under the pressure of the gas flow along the inflation conduit 200. The valve 400 may automatically configure between an open condition which allows the passage of gas along the inflation conduit 200 in order to ingress through the opening 301, and a closed condition which helps prevent the passage of gas along the inflation conduit 200 in order to egress through the opening 301.

Figure 14:
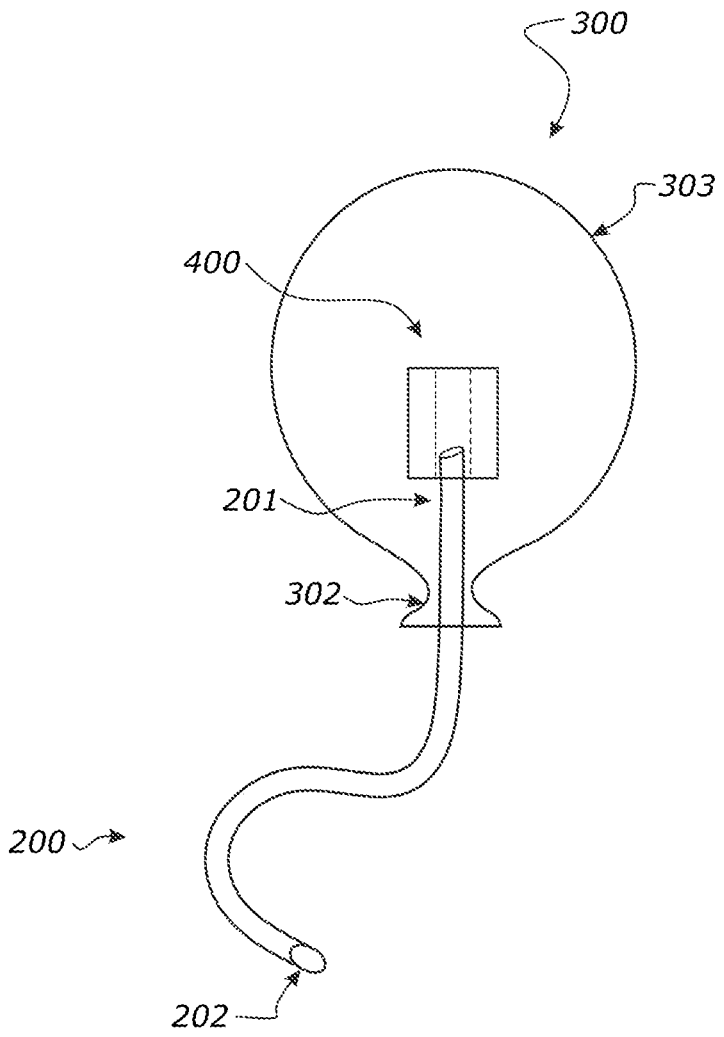
FIG. 14 shows an embodiment of a balloon comprising an inflatable body with a neck region projecting outwardly of the inflatable body and defining an opening of the inflatable body, wherein the balloon is connected to an inflation conduit that extends into the interior of the inflatable body through the opening at the neck, and wherein the end of the inflation conduit is connected to a duckbill valve.

In some embodiments the valve 400, preferably a one-way valve 400, is located inside of the balloon 300. For example, as shown in FIG. 14, the first end 201 of the inflation conduit 200 may extend a significant distance into the interior of the inflatable body 303. The one-way valve 400 may be connected at the first end 201 of the inflation conduit 200. The opening 301 of the inflatable body 303 may be sealed off so that the only way for gas to ingress or egress from the inflatable body 303 is via the inflation conduit 200. As pressurized gas is supplied through the inflation conduit 200 to inflate the balloon 300, the one-way valve 400 automatically opens to allow the gas into the inflatable body 303. Once inflation is completed, and the pressurized gas supply along the inflation conduit 200 is stopped (for example by removing the inflated balloon 300 and its associated conduit 200 from fluid communication with the pressurized gas supply) the pressure inside the inflatable body 303, being higher than ambient, causes the valve 400 to configure to its closed condition so as to help prevent the egress of gas from the inflatable body 303.

In some embodiments the one-way valve 400 may be a duck-bill valve 400. Although there are variations on how a duck-bill valve 400 may be constructed, in one example the duck-bill valve 400 may comprise two plies 401 of material joined with one another (for example by lamination) in a manner to define a sealable passage therethrough. The plies 401 may be made from flexible thin sheet material. Examples of suitable materials include thin sheets of polyurethane, polyester, polypropylene or PVC, which may be, for example, less than 1 mm in thickness. Rubber or silicone materials may also suitably be used. The duckbill valve 400 itself may be of relatively small dimensions, for example around 30 mm long and 15 mm across, and of a thin or substantially flat profile in the closed condition. This assists to minimize the volume of the balloon 300 when flaccid, and may improve the space efficiency in packaging a plurality of the balloons 300 in a retail pack.

Figure 15A:
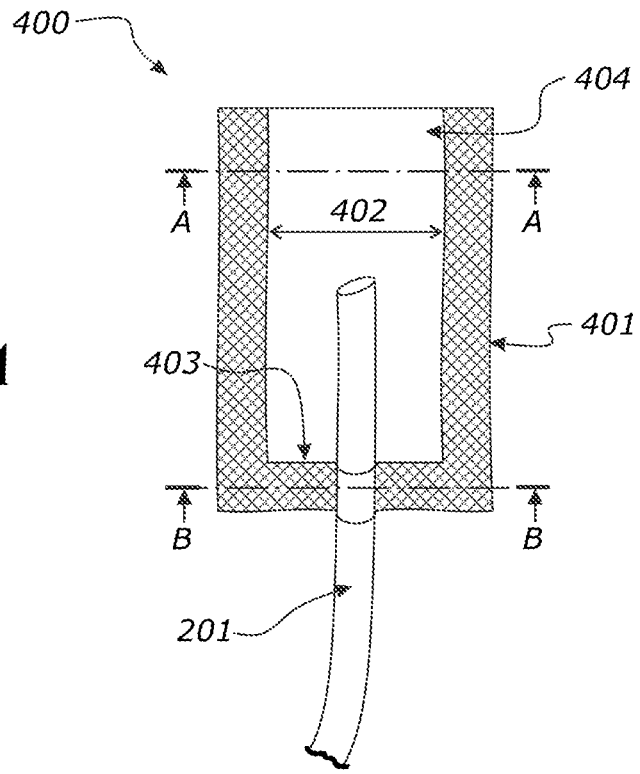
FIG. 15A shows further detail of the duckbill valve shown in FIG. 14.
Figure 15B:
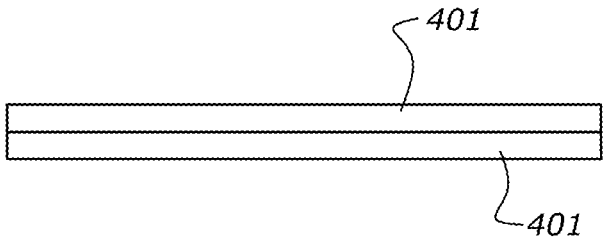
FIG. 15B shows a section view through plane A-A denoted on FIG. 15A when the valve is configured to a closed condition.
Figure 15C:
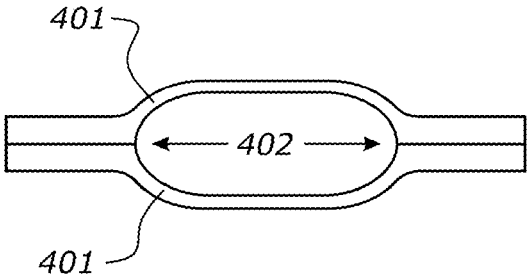
FIG. 15C shows a section view through plane A-A denoted on FIG. 15A when the valve is configured to an open condition.
Figure 15D:
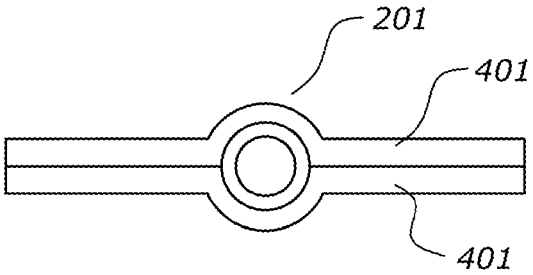
FIG. 15D shows a section view through plane B-B denoted on FIG. 15A

An example of a suitable duckbill valve is shown in FIGS. 15A through 15D. The valve comprises two plies 401, which are movable between the closed condition shown in FIG. 15B and the open condition shown in FIG. 15C. The first end 201 of the inflation conduit 200 may be inserted into the sealable passage through a first end 403 of the sealable passage, and sealed against the plies 401 in a manner to close off the first end 201 of the sealable passage as shown in FIG. 15D. It is possible to achieve this construction, for example, by laminating the two plies 401 of the valve 400 together with the end of the inflation conduit 201 in situ, such that the plies 401 adhere to one another and also to the exterior of the inflation conduit 200. The adhesion zones may be as shown in cross hatching in FIG. 15A. As the plies 401 are flexible, the second end 404 of the sealable passage can be collapsed to seal the passage about the end of the inflation conduit 200, thus corresponding to the closed condition of the valve 400.

When pressurized gas is supplied to the inflation conduit 200 in order to inflate the balloon 300, the gas will egress from the first end 201 of the inflation conduit 200 and automatically configure the duck-bill valve 400 to its open condition by forcing open the passage 402 between the plies 401. Once inflation is completed, and the pressurized gas supply along the inflation conduit 200 is stopped (for example by removing the inflated balloon 300 and its associated conduit 200 from fluid communication with the pressurized gas supply), the pressure inside the inflatable body 303, being higher than ambient, pushes on the plies 401 to collapse the second end 404 of the passage about the end of the inflation conduit 201 and closes the valve 400.

Should any gas leak from the balloon 300 such as through the wall of the inflatable body 303 and/or through the valve 400 and/or through the opening 301 of the inflatable body 303, it is possible to replenish gas inside the balloon 300. Such leakage may cause the balloon 300 to at least partially deflate and a replenishing, for example by a user orally blowing air into the second end 202 of the inflation conduit 200 and through the duck-bill valve 400, is able to cause the balloon 300 to be re-inflated. The duckbill valve 400, as described, can be configured to its open condition under a fairly low pressure gas flow, which makes it possible for a user to orally re-inflate the balloon without difficulty. Replenishing could also be achieved in others ways, for example by connecting the balloon 300 with a gas supply as previously described in relation to the initial inflation procedure.

In some embodiments the plies 401 may be made from a thin sheet material, or materials, with a capacity to develop and hold an electrostatic charge. Examples of suitable materials could include polyurethane, polyester, polypropylene or PVC. The electrostatic charge may assist in attracting the plies 401 toward one another to enhance sealing of the valve 400, for example when the plies 401 assume their closed condition as shown in FIG. 15B. In some examples the plies 401 may develop an electrostatic charge upon separation from one another as air is forced through the conduit 200 and the plies 401 assume their open condition shown in FIG. 15C. In some embodiments both of the plies 401 may be made from the same material. In other embodiments the plies 401 may be made of different materials. For example the two different materials may be separated in the triboelectric series. Features of the ply materials, such as surface roughness, may be selected to enhance the development of electrostatic charge.

In order for the system to function as described above, it is necessary to seal off the opening 301 of the inflatable body 303 around the inflation conduit 200 with a gas-tight seal. This could be achieved, for example, by clamping, stretching or bonding the opening 301 of the inflatable body 303 about the exterior of the inflation conduit 200. In some embodiments, the opening 301 may be provided at an outwardly projecting neck 302 of the inflatable body 303, in which case it may be convenient to clamp, stretch or bond the neck 302 about the exterior of the inflation conduit 200 in order to seal the inflatable body 303. For example a metal clip could be clipped to the exterior of the neck 302 in order to clamp it in place around the exterior of the inflation conduit 200 as shown in FIG. 4. The opening 301 of the inflatable body 303 is hence sealed around the inflation conduit 200.

In some embodiments the inflatable body 303 may be made of an elastic material, and the opening 301 of the inflatable body 301 may be significantly smaller than the outer diameter 204 of the end of the inflation conduit 201. In such embodiments the opening 301 may be stretched over the end of the inflation conduit 201 and allowed to contract about the conduit 200 to effect a sealing of the opening 301 against the exterior of the conduit 200.

In other embodiments the opening 301 may be provided at a neck 302 of the inflatable body 303, and at least a portion of an interior surface 305 of the neck can be bonded to itself forming at least one bonded region 306 to seal the opening 301, save for a passage 307 leading from the opening into the interior of the inflatable body 303. The passage 307 may accommodate the ingress/egress of air via the inflation conduit 200. For example, the passage 307 may accommodate the first end 201 of the inflation tube extending through the passage 307 and into the interior of the inflatable body 303. As a further example the passage 307 may accommodate the valve 400, or parts of the valve, extending through the passage 307, and in some such embodiments the valve 400 may be adapted to connect with the inflation conduit 200.

At the bonded region 306 at least a portion of an interior surface 305 of the neck 302 is bonded to itself, for example by folding of that portion of the neck back onto itself as shown in FIGS. 17E, 17F, 17G and 17H. In such embodiments this may give the bonded region 306 a flattened profile as shown.

The opening 301 may be sealed with a single bonded region 306, save for the passage 307, for example as shown in FIG. 17F. In other embodiments there may be more than one bonded region 306. For example, as shown in FIGS. 17E and 17H, there may be at least two bonded regions 306 located on either side of the passage. In the embodiment where there is a single bonded region 306 extending across the neck 302 save for the passage 307, or in the embodiment where there are two bonded regions 306 on either side of the passage 307, the whole neck region 302 may have a substantially flat profile all the way across it. This may also be the case if the valve 400, which may be carried inside of the neck 302, also has a substantially flattened profile as shown in FIG. 17H. However, in other embodiments the neck region 302 may not have a flat profile all the way across it. For example, FIG. 17G shows that there may be multiple bonded regions 306, for example extending radially outward of the passage 307.

In some embodiments the opening 301 may be of a size large enough to extend all the way across the neck region 302, but in other embodiments it may extend just part of the way across. The passage 307 may be of significantly smaller size than the opening 301, for example less than ½ or ¼ of the size. In some embodiments the external diameter 204 of the inflation conduit 200 may correspond with the size of the passage 307.

In some embodiments, for example as shown in FIGS. 17E, 17F and 17G, the interior surface 305 of the neck 302 may be bonded directly to itself at the bonded region 306. In other embodiments, a portion of the neck 302 may be folded back onto it itself, and the interior surface 305 may be bonded to itself with an intermediate layer (for example provided by a component of the balloon or inflation conduit) laying between the interior surface 305, or at least a part of it. An example is shown in FIG. 17H, wherein a duckbill valve 400 with a substantially flattened profile is bonded into the neck region 302 such that the plies 401 and 402 of the valve lies between at least a part of the interior surface 305 of the neck 302 which is bonded to itself at the bonded region 306. In this FIG. 17H the valve 400 is also bonded at the bonded region 306 to secure it in place at the neck 302.

The passage 307 may accommodate the inflation conduit 200, or the valve 400, extending there through. For example, the valve 400 may comprise a connector 600 which extends through the passage 307, to present an end 601 of the connector outside of the opening 301 which is adapted for engagement with the inflation conduit 200. In such embodiments, there may be at least a second portion 308 of the interior surface 305 of the neck region 302, said second portion 308 being a portion that defines the passage 307, which is bonded to the region of the inflation conduit 200 or the valve 400 which extends through the passage 307.

Figure 18A:
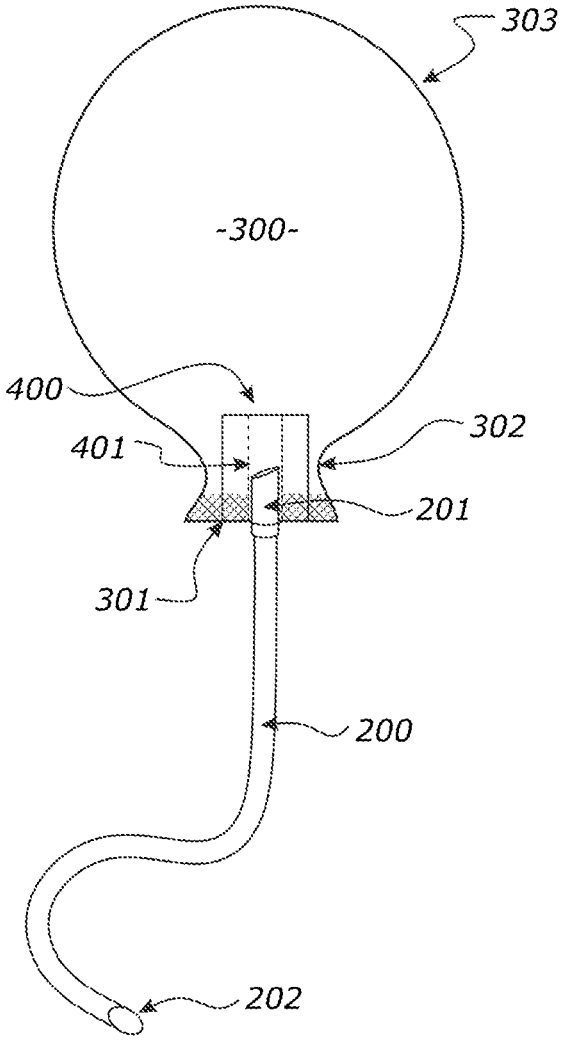
FIG. 18A shows further detail of the bonded region at the neck of the balloon shown in FIG. 16A.
Figure 19A:
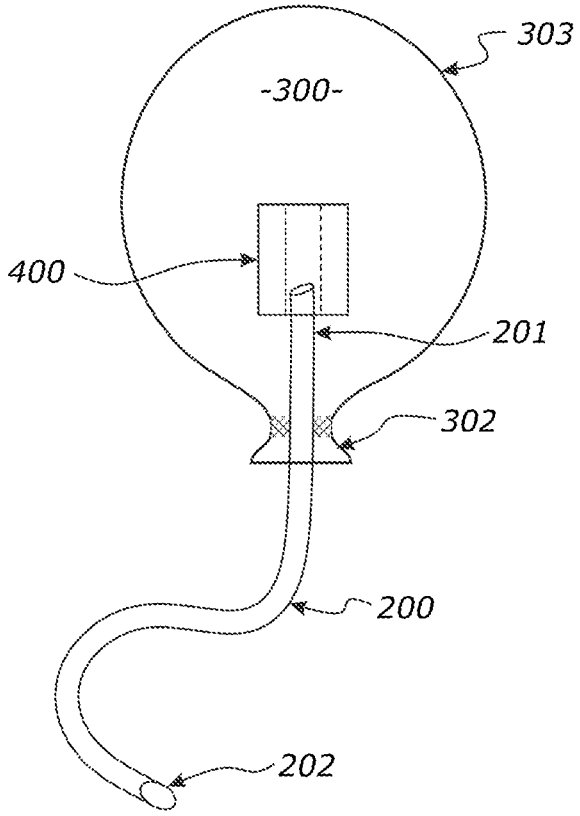
FIG. 19A shows further detail of a bonded region which may seal the neck of the balloon shown in FIG. 14.
Figure 19B:
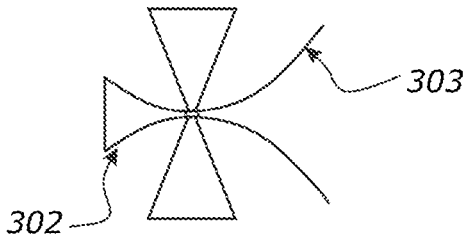
FIG. 19B shows a schematic view, from side on, of how the bonded region shown in 19A may be formed by pinching the neck of the balloon between two opposing blade-like surfaces.
Figure 19C:
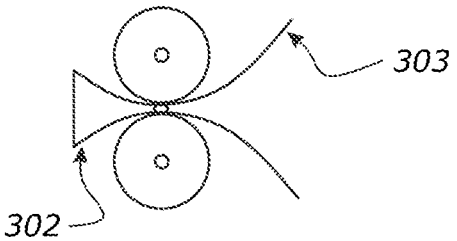
FIG. 19C shows a schematic view, from side on, of how the bonded region shown in 19A may be formed by pinching the neck of the balloon between two rollers.

Now follow some examples of how it may be possible to achieve the above-described structure of the balloon 300, having a portion of the neck 302 that is bonded to itself to seal the opening 301 save for a passage 307 leading from the opening 301 into the neck region 302. For example, in some embodiments, the opening 301 is provided at a neck 302 which projects outwardly of the inflatable body 303, and the diameter of the neck 302 is significantly larger than the external diameter 204 of the inflation conduit 200. For example, the external diameter 204 of the inflation conduit 200 may be less than ½ of the diameter of the neck opening 302, and in some embodiments less than ¼ of the diameter. In such embodiments the neck 302 may be pressed closed with the inflation conduit 200 in situ and secured, for example by bonding with an adhesive or heat weld. FIGS. 18A and 19A show examples of bonded regions 306 extending across the neck 302 in cross hatching. For example, the bond may be achieved by applying adhesive in a flowable state to the inner surfaces of the neck 302, inserting the first end 201 of the inflation conduit 200 into the neck 302, and then pressing the neck 302 closed with the inflation conduit 200 in situ before curing the adhesive. The adhesive, while in its flowable state, may bead up across the opening 301 and adhere to the surfaces of the inflation conduit 200 to ensure that the inflation conduit 200 is held in place relative to the neck 302 and a gas-tight seal is formed. An advantage of bonding the neck 302 in this manner is that the bond is not externally visible. This may be more visually appealing than applying an exterior clip to seal the neck 302 and attach the balloon 300 to its respective inflation conduit 200.

Figure 16A:
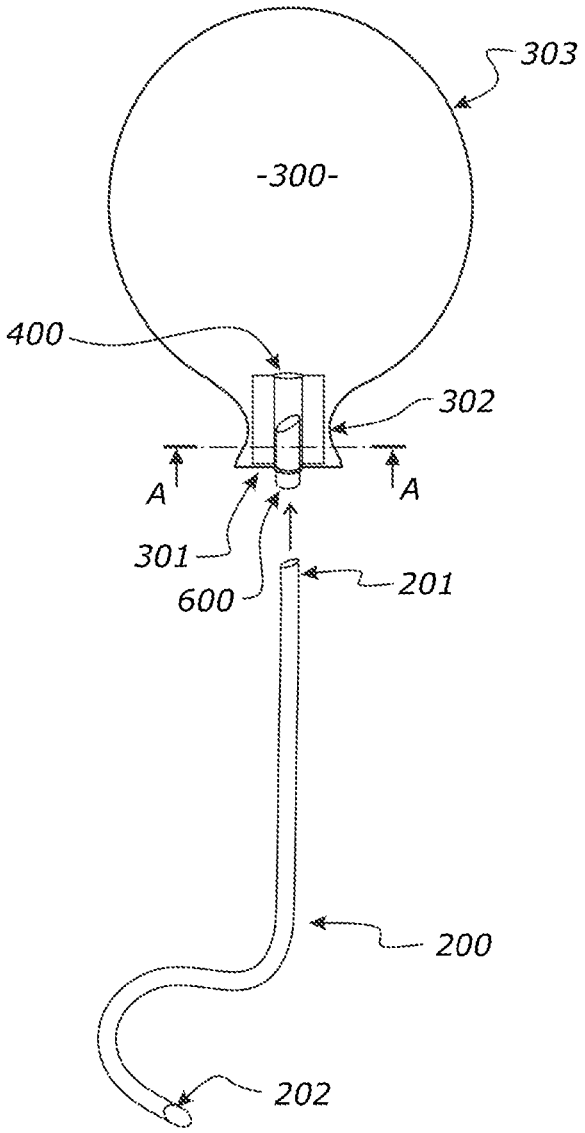
FIG. 16A shows an embodiment of a balloon comprising an inflatable body with a neck region projecting outwardly of the inflatable body and defining an opening of the inflatable body, wherein the balloon carries a duckbill valve at the opening of the neck, and wherein the opening, and wherein the opening of the inflatable body is sealed by a bonded region extending across the neck (having been formed by pressing or pinching the neck closed with valve in situ) and wherein the valve carries a connector for releasable connection with an inflation conduit.
Figure 16B:
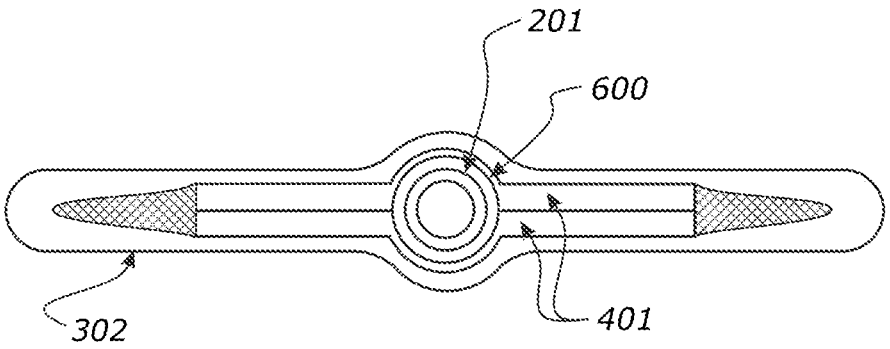
FIG. 16B shows a section view through plane A-A denoted on FIG. 16A.
Figure 17A:
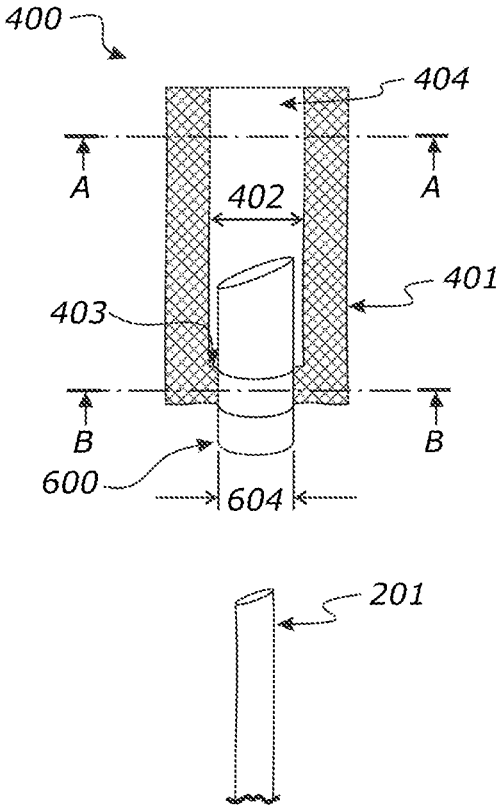
FIG. 17A shows further detail of the duckbill valve and connector shown in FIG. 16A.
Figure 17B:
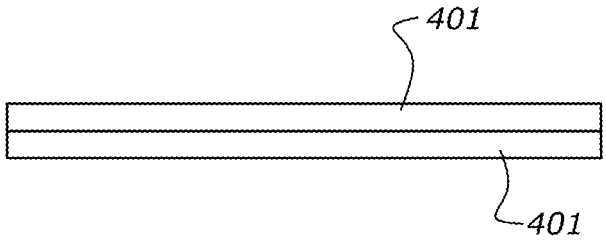
FIG. 17B shows a section view through plane A-A denoted on FIG. 17A when the valve is configured to a closed condition.
Figure 17C:
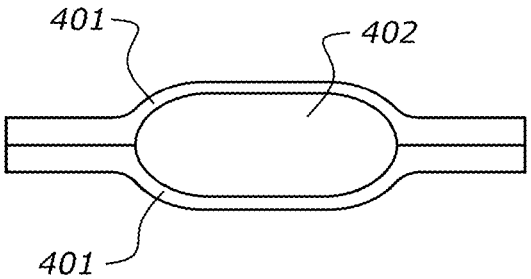
FIG. 17C shows a section view through plane A-A denoted on FIG. 17A when the valve is configured to an open condition.
Figure 17D:
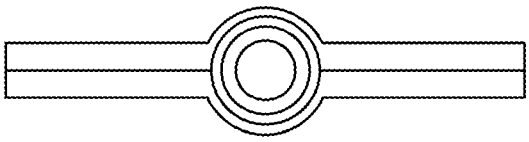
FIG. 17D shows a section view through plane B-B denoted on FIG. 17A.
Figure 18B:
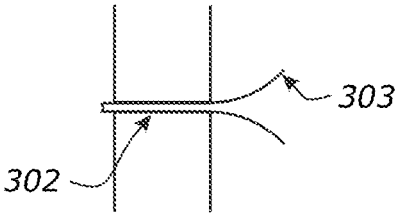
FIG. 18B shows a schematic view, from side on, of how the bonded region shown in 18A may be formed by pressing the neck of the balloon between two flat surfaces.

As used herein, "pressing" can be used to describe a process, as a step in a method for the manufacture of a balloon 300, of applying pressure by two plate-form surfaces located on either side of the neck 302 that squeeze the neck between them, for example as shown side on in FIG. 18B. Pressing the opening of the neck 302 closed in this manner, with the end 201 of the inflation conduit 200 and/or the valve 400 in situ, may result in a flattened neck region on either side of the conduit/valve as can be seen in FIG. 16B. As used herein "pinching" can be used to describe a process, as a step in a method for the manufacture of a balloon 300, of applying pressure by two roll-form or blade-form surfaces located on either side of the neck that come into contact with one another to apply pressure in a line across extending across the neck 302, for example as shown in FIG. 19A. Pinching the opening of the neck 302 closed in this manner, with the end 201 of the inflation conduit 200 and/or the valve 400 in situ, may result in a flattened neck region on either side of the conduit/valve as can be seen in FIG. 16B. In some embodiments the pressure applying surfaces may need to be deformable to some extent (for example, made of a deformable foam or rubber) in order to accommodate the contours of the inflation conduit and/or valve situated in the neck during a bond-forming process by pressing or pinching.

In some embodiments the inflation conduit 200 may extend into the interior of the inflatable body 303 through the passage 307, such that a valve 400 attached at an end 201 of the inflation conduit 200 may be positioned inside of the balloon 300 at a significant distance from the opening 301. However in some embodiments the first end 201 of the inflation conduit 200 may not extend any significant distance into the interior of the inflatable body 303, and instead the valve 400 may be located inside of the inflatable body 303, right at the opening 301. In such embodiments the first end 201 of the inflation conduit 200 may extend only a small distance inside the opening 301, as far as necessary to sealingly engage with the valve 400. In an exemplary embodiment, as shown in FIG. 18A, the opening 301 is at a neck 302 outwardly projecting from the inflatable body 303, and the valve 400 (being a duck-bill valve 400 of two ply construction as previously described) is situated within the neck 302 to close off the opening 301. The first end 201 of the inflation conduit 200 passes through the opening 301 and is received inside the internal passage of the valve 400. The neck 302 may be pressed closed and bonded with the inflation conduit 200 and valve 400 in situ (as previously described in relation to FIG. 18A) in order to seal the opening 301 and to secure the valve 400 and inflation conduit 200 in place. In this configuration it may be possible to incorporate a lower edge of the plies 401 into the bonded region to secure the valve 400 in place. In embodiments where the plies 401 are made of a thermoplastic material, and the bond is formed by heat-welding, it may be possible to incorporate the valve 400 into the bonded region by fusing the plies 401 with the inner surface of the neck 302 and/or the exterior of the inflation conduit 200.

In the embodiments described in FIGS. 14 and 18A the balloon 300 is permanently fixed to the inflation conduit 200 for example, by clamping, stretching or bonding the opening 301 of the inflatable body 303 about the exterior of the inflation conduit 200. But in alternative embodiments the balloon 300 may be releasably connected to the inflation conduit 200. In some such embodiments where the balloon 300 is releasably connected to the inflation conduit 200, it may be desirable that a valve 400 remain associated with the balloon 300 in order to help prevent the egress of gas from the opening 301 in the inflatable body 303 after the inflation conduit 200 has been removed. An example of how this may be achieved is shown in FIG. 16A, wherein the valve 400 includes a connector 600 that can receive the first end 201 of the inflation conduit 200 in a sealed engagement. The sealed engagement could, for example, be by way of a friction fit, or by way of a threaded engagement. The inflation conduit 200 can be disengaged and withdrawn from the connector 600 in order to permit detachment of the balloon 300, yet the valve 400 remains inside of the balloon 300 to seal the opening 301 and help prevent deflation.

In the embodiment shown in FIG. 16A the opening 301 is at a neck 302 outwardly projecting from the inflatable body 303, and the valve 400 (being a duck-bill valve 400 of two ply construction as previously described) is situated within the neck 302 to close off the opening 301. The connector 600 may be a rigid component of tubular form, positioned at least partially within the internal passage of the valve 400. The connector 600 may have an external diameter 604 of less than ½, or even less than ¼ of the diameter of the neck 302 opening 301. In some embodiments the internal diameter of the connector 600 is large enough to accommodate the first end 201 of the inflation conduit 200 inside of the connector 600. In other embodiments, the inflation conduit 200 may engage by fitting over the exterior of the connector 600

The connector 600 may be located to protrude some distance out from the first end 201 of the passageway, and also to extend out from the opening 301 of the inflatable body 303. The neck 302 may be pressed closed and bonded with the connector 600 and valve 400 in situ (similar to the process previously described in relation to FIGS. 18A and 19A) in order to seal the opening 301 and to secure the valve 400 and connector 600 in place. In this configuration it may be possible to incorporate a lower edge of the plies 401 into the bonded region to secure the valve 400 in place. For example, the bond may be achieved by applying adhesive in a flowable state to the inner surfaces of the neck 302, and then pressing the neck 302 closed with the connector 600 in situ before curing the adhesive. The adhesive, while in its flowable state, may bead up across the opening 301 and adhere to the surfaces of the connector 600 to ensure that the connector 600 is held in place relative to the neck 302 and that a gas-tight seal is formed.

Detail of an exemplary two ply 401 duckbill valve 400 is shown in FIGS. 17A to 18D. FIG. 17B shows the plies 401 in the open condition. And FIG. 17C shows the plies 401 in the open condition. The first end 201 of the inflation conduit 200 may be received inside the connector 600 and retained by way of a friction fit. This is preferably sufficiently tight or of a configuration that helps prevent leakage of air from between the first end 201 and the connector 600. The balloon 300 can be detached from the inflation conduit 200 by withdrawing the inflation conduit 200 from the connector 600. The valve 400 serves to seal the opening 301 of the inflatable container to restrict the egress of gas even when the balloon 300 is detached from the inflation conduit 200. The balloon 300 can be re-attached to the inflation conduit 200 by reinserting the inflation conduit 200 into the connector 600, for example if reinflation of the balloon 300 is desired.

If a user desires to deflate the balloons 300 (for example if the balloons 300 are to be deflated for storage between subsequent uses), then deliberate deflation can be achieved by inserting a tube into the valve 400, all the way through the internal passage 402, and into the interior of the inflatable body 303. Doing so brings the inflatable body 303 into fluid communication with the ambient atmosphere so that gas can flow out of the balloon 300 via the tube. In some embodiments, such a tube for the purposes of deflation may be supplied along with the other components of the system. For example such a deflation tube may be supplied as an attachment to the pressurized gas supply source 100.

The embodiment shown in FIGS. 16A and 16B also permits the balloon 300 to be integrity tested prior to its provision for use with the other components of the balloon 300 inflation system. During integrity testing of the balloons 300 it may be desirable to deliver a pulse of compressed air into the inflatable body 303 and observe whether there are any pin-pricks or holes in the inflatable body that allow air to leak out. In such cases, the balloon 300 may be provided in a condition wherein the opening 301 of the inflatable body 303 has been sealed with a valve 400 and connector 600 in situ as described in relation to FIG. 18A. As a subsequent step in testing, the connector 600 of the balloon 300 can then be conveniently and swiftly engaged with a compressed air delivery nozzle to deliver air to at least partially inflate the inflatable body 303. If the balloon 300 fails the integrity test then can be discarded. If the balloon passes the integrity test, then it may be included in a system, assembly, retail pack and/or kit for inflating a plurality of balloons as previously described.

Figure 20A:
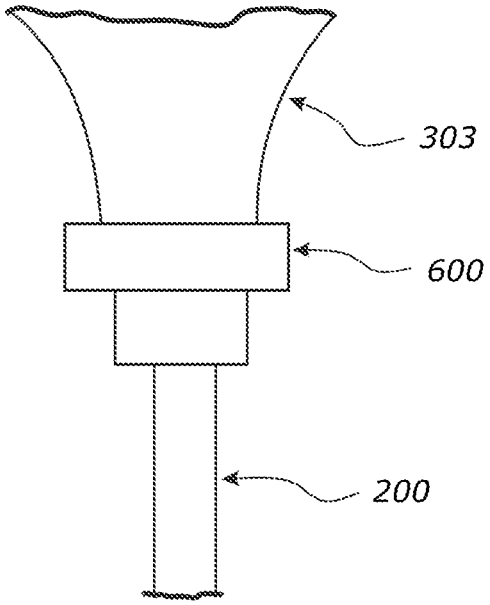
FIG. 20A shows an embodiment of a connector for releasable connecting the inflatable body of a balloon with an inflation conduit, and bridging between the end of the inflation conduit and the valve carried inside of the inflatable body.
Figure 20B:
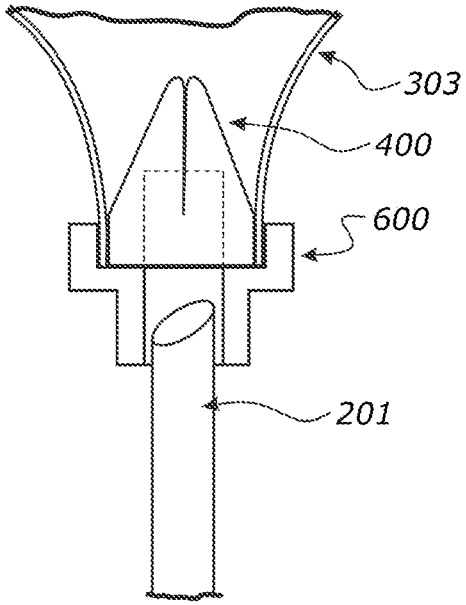
FIG. 20B shows a cut away view of the connector of FIG. 20A.

In some of the embodiments described above the releasable connection between the balloon 300 and the inflation conduit 200 is conveniently provided by a connector which is integral to the valve. In other embodiments the connector need not be integral to the valve, and could for example wrap, tie or clip around the neck of the balloon in order to effect a releasable engagement. In another example the connector could be a separate piece which engages with the valve at a first end, and engages with the inflation conduit at a second, opposite end to bridge between the valve and the inflation conduit as shown in FIGS. 20A and 20B.

Figure 19D:
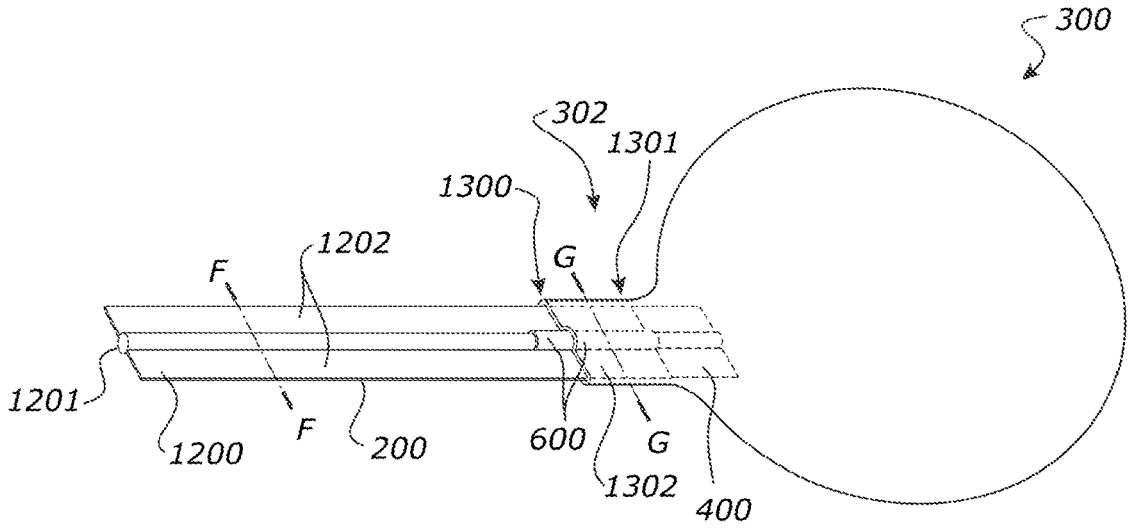
FIG. 19D shows an alternative embodiment of a balloon and tether able to act as an inflation conduit.
Figure 19E:
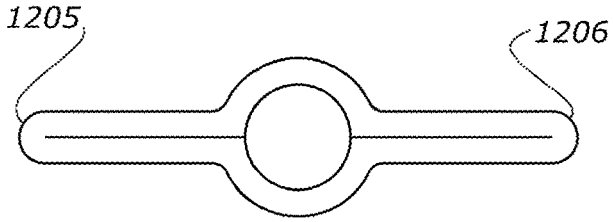
FIG. 19E is a cross section of section FF of FIG. 19D.
Figure 19F:
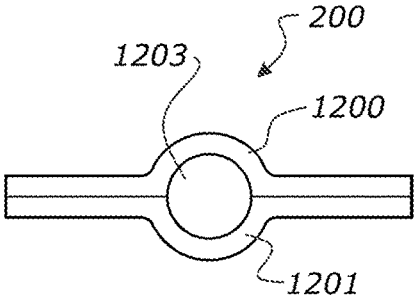
FIG. 19F is a cross section of an alternative at section FF of FIG. 19D.
Figure 19G:
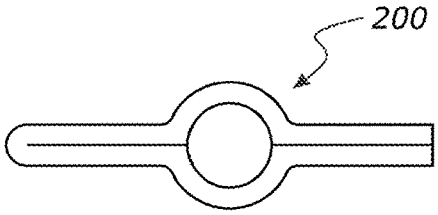
FIG. 19G is a cross section of an alternative at section FF of FIG. 19D.
Figure 19H:
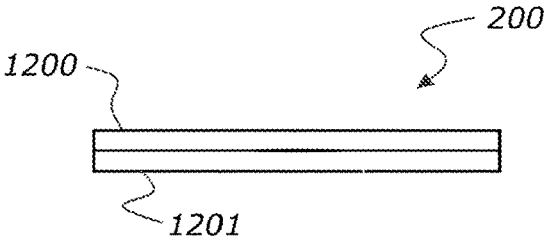
FIG. 19H is a cross section of an alternative at section FF of FIG. 19D.
Figure 19I:
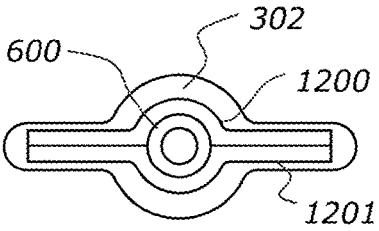
FIG. 19I is a cross section of section GG of FIG. 19D.
Figure 19J:
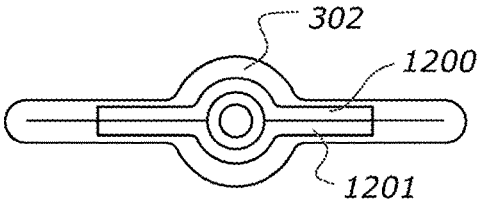
FIG. 19J is a cross section of an alternative at section GG of FIG. 19D.

In FIG. 19D there is shown a balloon 300 wherein the inflation conduit 200 is secured at the neck 302 of the balloon. The inflation conduit may be made from two plies 1200 and 1201 of a sheet material. The material of the inflation conduit may for example be a foil material. An example of the construction of the inflation conduit can be seen in FIG. 19F in cross section. The two plies may be heat sealed and/or adhesively bonded at bonding zones 1202 adjacent the passage 1203 via which gas can be delivered to the balloon. The inflation conduit may instead be made from one sheet material and folded at folds 1205 and 1206 as seen in FIG. 19E. The use of a sheet material such as a foil material allows the inflation conduit to assume a flat or near flat condition as seen in FIG. 19H and for the passage 1203 to be formed when a gas under pressure is introduced to the passage. The inflation conduit 200 is preferably engaged to the balloon at the neck as seen in FIG. 19D in a manner as herein described such as by way of using an adhesive. The interior surface of the neck may be directly bonded to the inflation conduit at the neck. The inflation conduit 1200 may be wide and so wide as to extend substantially entirely across the bonded region as seen in FIG. 19I. Alternatively it may extend only partly across the bonded region as seen in FIG. 19J so that parts of the interior surface of the neck are bonded to each other. A connector 600 may be provided at the neck to connect the inflation conduit to the valve. Alternatively the valve may be formed as an extension of the inflation conduit. A connector 600 may still be provided in such an arrangement. A connector provides a passage therethrough. The connector is preferably of a rigid material so at to ensure that the passage through the connectors does not collapsed due to the balloon material adjacent. The connector may extend from one end 1300 of the bonded region 1302 to the other end 1301 of the bonded region 1302.

Tether

In some embodiments the balloon 300 may be supplied with a connected tether 500. In such embodiments the connected tether 500 may be provided in addition to the inflation conduit 200, which can in some embodiments serve as an alternative tether, anchor or handle of the balloon 300. The tether 500 may be between 200-1200 mm long, and in some embodiments between 500-1000 mm, or 700-900 mm long. In some embodiments it may be the case the tether 500 is at least as long, or longer, than the inflation conduit 200.

In some embodiments the tether 500 may be of a flexible cord form, for example as a fibrous rope or thread. In other embodiments the tether 500 may be of a flexible strip form, for example as a thin, flat strip of paper or flexible plastic.

Figure 21:
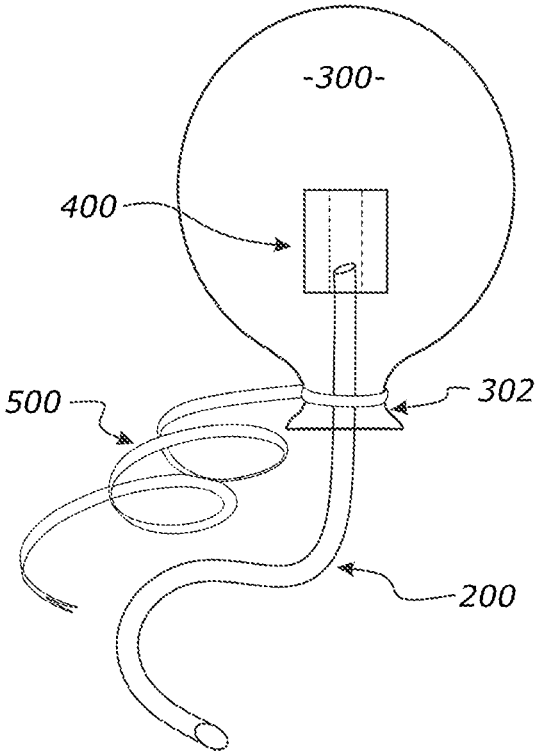
FIG. 21 shows an embodiment of a balloon with a releasable tether tied about a neck of the balloon.

The tether 500 may be supplied in a rolled up configuration so as to avoid tangling with the tether 500*s* of adjacent balloons 300. In some embodiments the tether 500 may be supplied in a coiled configuration, for example as shown in FIG. 21. The tether provided in a coiled configuration may be conveniently wrapped around a bar or post in order to efficiently secure the balloon.

In some embodiments the tether 500 may be releasably connected to the balloon 300. For example, the tether 500 may be tied about the neck 302 as shown in FIG. 21. In other embodiments the tether may be permanently connected either of both of the balloon 300 and the inflation conduit 200.

In embodiments (such as that shown in FIG. 19A) where the balloon 300 is permanently connected to the inflation conduit 200, the tether 500 may be incorporated into the connection between the balloon 300 and the inflation conduit 200 to permanently fix it in place. For example, the end of the tether 500 may be inserted into the bonded region while the adhesive is still in a flowable state and will remain fixed in place once the adhesive cures. In such embodiments, the inflation conduit 200 may be made of a severable material, and may be severed near to the neck 302 of the balloon 300 post inflation to leave the tether 500 remaining as the only means to tether or anchor the inflated balloon 300.

Figure 22:
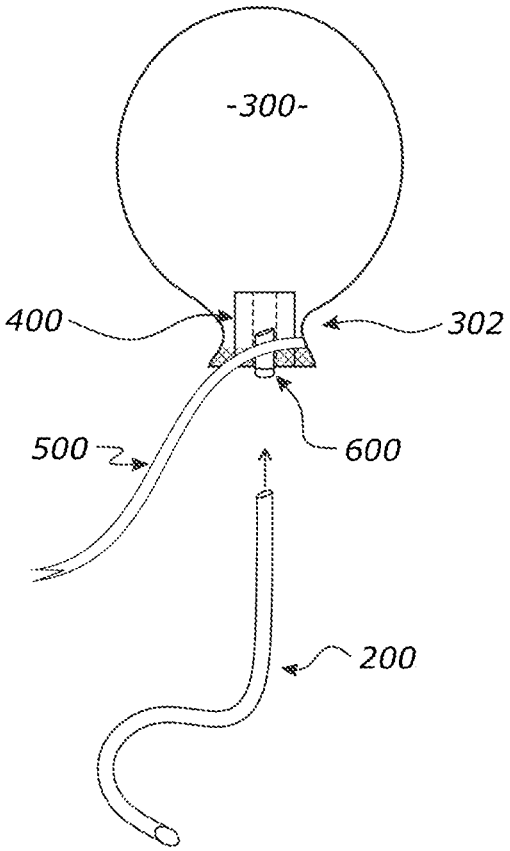
FIG. 22 shows an embodiment of balloon with a permanently connected tether, wherein the tether is incorporated into a bonded region which extends across the neck of the balloon.
Figure 23:
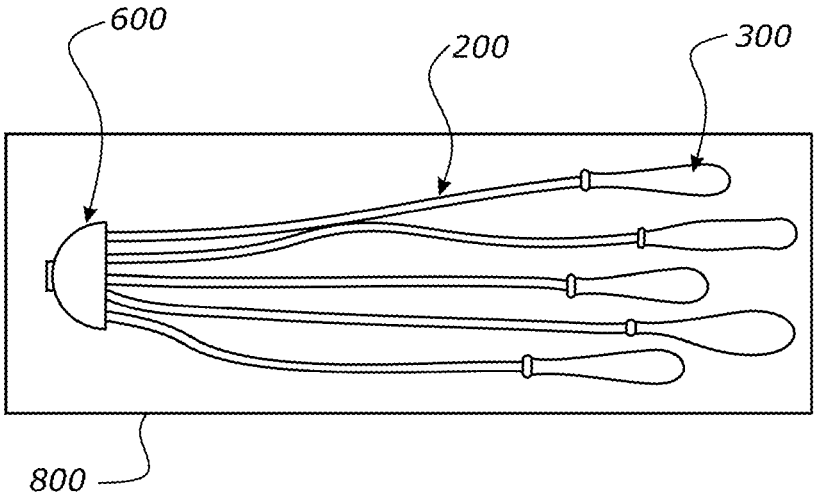
FIG. 23 shows an embodiment of a retail pack containing various components of a system for simultaneously inflating a plurality of balloons, including a plurality of balloons each with an associated inflation conduit, and an adapter configured to accommodate the inflation conduits for simultaneous connection to the outlet of a pressurized gas supply source.

In embodiments where the balloon 300 is releasably attached to the inflation conduit 200, the tether 500 may be permanently connected to the balloon 300. For example, the balloon 300 may be bonded to a connector 600 piece inside of the valve 400 by an adhesive applied in a flowable state, which connector 600 can be releasably attached to an inflation conduit 200. FIG. 22 shows how the end of the tether 500 may be inserted into the bonded region of the neck 302, valve 400 and connector 600 while the adhesive is still in a flowable state and will remain fixed in place once the adhesive cures. In such embodiments, the inflation conduit 200 may be detached from the balloon 300 post inflation to leave the tether 500 remaining as the only means to tether or anchor the inflated balloon 300.

While the disclosure references several particular embodiments, those skilled in the art will be able to make various modifications to the described embodiments without departing from the true spirit and scope of the disclosure. It is intended that all elements or steps which are insubstantially different from those recited in the claims but perform substantially the same functions, respectively, in substantially the same way to achieve the same result as what is claimed are within the scope of the disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A balloon for use in a system for inflating balloons with pressurized gas issuing from a pressurized gas supply, said balloon comprising an inflatable body with a neck region defining an opening of the inflatable body through which pressurized gas can pass to inflate the balloon, and wherein said balloon is connectable to an inflation conduit that is adapted to duct pressurized gas from the pressurized gas supply to said inflatable body, and wherein said balloon comprises a connector to releasably connect the balloon with the inflation conduit, and wherein said balloon comprises a valve configurable between an open condition to permit the entry of gas to the inflatable body via the inflation conduit and a closed condition to restrict the egress of gas from said inflatable body via the inflation conduit, said valve being located inside the inflatable body, and wherein at or adjacent the opening at least a first portion of an interior surface of the neck region is bonded to itself forming at least one bonded region to the seal the opening, save for a passage leading from the opening into the neck region.

2. The balloon of claim 1 wherein either:

a) the opening is sealed with a single bonded region, save for the passage leading from the opening into the neck region; or b) a portion of an interior surface of the neck region is bonded to itself forming a first bonded region, and wherein a further portion of the interior surface of the neck region is bonded to itself forming a second bonded region, and wherein the first and second bonded regions together seal the opening, save for the passage leading from the opening into the neck region, the first and second bonded regions being located on either side of the passage.

3. The balloon of claim 1 wherein the opening defined at the neck of the inflatable body has a width, and the passage at said at least one bonded region has a width, and wherein the width of the passage is less than ½ of the width of the opening and optionally less than ¼ of the width of the opening.

4. The balloon of claim 1 wherein the bonded region(s) has/have a flat profile.

5. The balloon of claim 1 wherein at the bonded region(s) said interior surface of the neck region is bonded directly onto itself.

6. The balloon of claim 1 wherein said valve is located at the opening of the inflatable body, inside of the neck region, and bonded to the neck region at least one of said bonded regions.

7. The balloon of claim 1 wherein the bonded region(s) has/have been formed by pressing or pinching the neck region with the valve in situ.

8. The balloon of claim 1 wherein said valve is a one-way valve that adopts a substantially flat profile in the closed condition.

9. The balloon of claim 8 wherein the valve is duckbill valve comprising two plies of flexible sheet material joined with one another in a manner to define a sealable passage therethrough.

10. The balloon of claim 9 wherein the connector is adapted to releasably engage with the first end of the inflation conduit at an engagement region, and wherein the connector is located at least partially inside a sealable passage of the valve with the engagement region projecting out of a first end of said passage, and wherein the plies of the valve are sealed around the exterior of the connector, and wherein the sealable passage of the valve is able to collapse at a second end so as to seal the passage about an end of the connector opposing the engagement region.

11. The balloon of claim 1 wherein said connector extends through the passage at the neck region of the inflatable body, and wherein at least a second portion of the interior surface of the neck region, said second portion being a portion that defines the passage, is bonded to the connector.

12. The balloon of claim 1 wherein said balloon has a permanently attached flexible tether of elongate cord or strip form.

13. The balloon of claim 1 wherein said inflatable body is made of an elastically expandable material.

14. A balloon assembly for use in a system for inflating balloons with pressurized gas issuing from a pressurized gas supply, comprising a balloon as claimed in claim 1 and an inflation conduit connected to said balloon.

15. A system for simultaneously inflating a plurality of balloons comprising a plurality of balloon assemblies, each one of said plurality of balloons assemblies being a balloon assembly as claimed in claim 14, and wherein each balloon assembly is joined with at least one other balloon assembly in the plurality of balloon assemblies by a severable connector located at their respective inflation conduits and providing a severable connection between their respective inflation conduits.

16. A method of simultaneously inflating a plurality of balloons with pressurized gas issuing from a pressurized gas supply via a plurality of inflation conduits, each of said inflation conduits being configured to duct pressurized gas from the pressurized gas supply to a respective one of the balloons, said method employing a plurality of balloon assemblies as claimed in claim 15, wherein said method comprises the steps of:

a) providing the plurality of balloon assemblies, each in fluid communication with the pressurized gas supply via a respective one of the inflation conduits; and b) simultaneously inflating the balloons with pressurized gas, and c) sealing the inflated balloons by closure of the valve located inside each one of the balloons.

17. The method of claim 16 wherein the method further comprises one or more steps selected from:

a) connecting the inflation conduits to be in fluid communication with the gas supply;

b) releasing the inflation tubes from fluid communication with the gas supply; and c) re-connecting one or more of the inflation conduits to be in fluid communication with the gas supply.

18. The method of claim 16 wherein the method further comprises one or more steps selected from:

a) connecting the balloons with the inflation conduits;

b) disconnecting the balloons from the inflation conduits; and c) re-connecting one or more of the balloons with respective ones of the inflation conduits.

19. The method of claim 16 wherein the method further comprises the step of tethering or anchoring one of more of the balloons using one or more selected from:

a tether connected to the balloon;

an inflation conduit; and a connector of the balloon which is adapted to connect to both of the inflation conduit and an corresponding connector of a balloon support surface or frame.

* * * * *